US011096468B2

(12) United States Patent
Mahoney et al.

(10) Patent No.: US 11,096,468 B2
(45) Date of Patent: Aug. 24, 2021

(54) MAKEUP APPLICATOR TO DEPOSIT A PATTERNED AND TEXTURED MAKEUP LAYER

(71) Applicant: L'Oreal, Paris (FR)

(72) Inventors: Zachary Mahoney, Freehold, NJ (US); Paula Galvao, Clark, NJ (US)

(73) Assignee: L'Oreal, Paris (FR)

( * ) Notice: Subject to any disclaimer, the term of this patent is extended or adjusted under 35 U.S.C. 154(b) by 210 days.

(21) Appl. No.: 16/228,399

(22) Filed: Dec. 20, 2018

(65) Prior Publication Data

US 2020/0196732 A1 Jun. 25, 2020

(51) Int. Cl.
*A45D 34/04* (2006.01)
*A45D 34/06* (2006.01)

(52) U.S. Cl.
CPC ..... *A45D 34/041* (2013.01); *A45D 34/06* (2013.01); *A45D 2200/10* (2013.01); *A45D 2200/25* (2013.01)

(58) Field of Classification Search
CPC .. A45D 34/041; A45D 34/06; A45D 2200/10; A45D 2200/25; A45D 40/30; B41M 5/0256; B41M 2205/10; B44C 1/16; B44C 3/085; B41K 1/42; B41K 1/22
See application file for complete search history.

(56) References Cited

U.S. PATENT DOCUMENTS 1,127,806 A * 2/1915 Pells et al. ..... B41K 1/22 101/329
2,641,182 A * 6/1953 Koffski ..... B41K 1/42 101/329
3,103,689 A * 9/1963 Borisof ..... A45D 34/041 401/2
3,374,050 A * 3/1968 Rabin ..... B44D 3/225 401/208
3,465,673 A * 9/1969 Oppenheim ..... B41K 1/56 101/328
3,577,918 A * 5/1971 Wayfield ..... B41K 1/46 101/328
3,646,885 A * 3/1972 Kolody ..... B41K 1/22 101/328
4,817,526 A * 4/1989 Winston ..... B41K 1/22 101/329
5,435,245 A * 7/1995 Salisbury ..... B41K 1/22 101/328
6,244,776 B1 * 6/2001 Wiley ..... B05C 17/0205 401/183
6,615,719 B1 * 9/2003 Winston ..... B41F 1/40 101/327

(Continued)

*Primary Examiner* — Nicholas D Lucchesi
(74) *Attorney, Agent, or Firm* — Christensen O'Connor Johnson Kindness

(57) ABSTRACT

An application utensil for transferring a coloring composition in one of many patterns onto skin includes a wheel comprising a pattern of raised and submerged regions on an outer tread surface of the wheel; a wheel well that supports the wheel and allows rotation of the wheel, wherein the wheel is removable from the wheel well; and a manual grip connected to the wheel well. A plurality of different application utensils and wheels are disclosed. Application utensils are interchangeable as are the wheels to allow many combinations according to consumer preference.

17 Claims, 17 Drawing Sheets

(56) References Cited

U.S. PATENT DOCUMENTS

| | | | | |
|---|---|---|---|---|
| 7,955,018 | B2 * | 6/2011 | Abergel | A45D 34/041 401/208 |
| 7,963,221 | B2 * | 6/2011 | Patterson | B41K 1/22 101/328 |
| 8,844,543 | B2 * | 9/2014 | Bickford | A45D 40/28 132/320 |
| 9,861,175 | B2 * | 1/2018 | Tanaka | A45D 34/041 |
| 9,993,059 | B2 * | 6/2018 | Langdon | A45D 34/041 |
| 10,378,144 | B2 * | 8/2019 | Hawley | D06F 71/30 |
| 10,513,133 | B2 * | 12/2019 | Czyzewski | B26F 1/24 |
| 2004/0129284 | A1 * | 7/2004 | Abergel | A45D 34/041 132/200 |
| 2006/0225579 | A1 * | 10/2006 | Errera | A21C 11/02 99/388 |
| 2007/0227552 | A1 * | 10/2007 | Abergel | A45D 40/261 132/294 |
| 2016/0316892 | A1 * | 11/2016 | Giron | A45D 40/30 |
| 2020/0254478 | A1 * | 8/2020 | O'Sullivan | B05C 17/0355 |

* cited by examiner

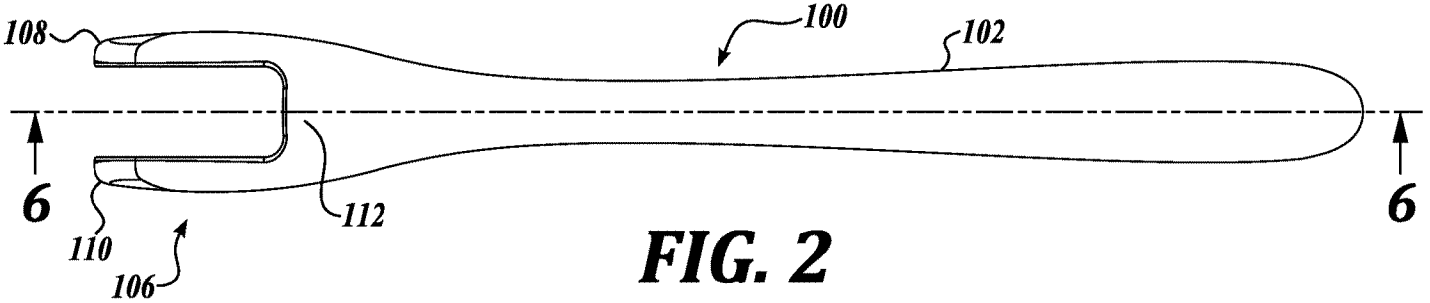
FIG. 2
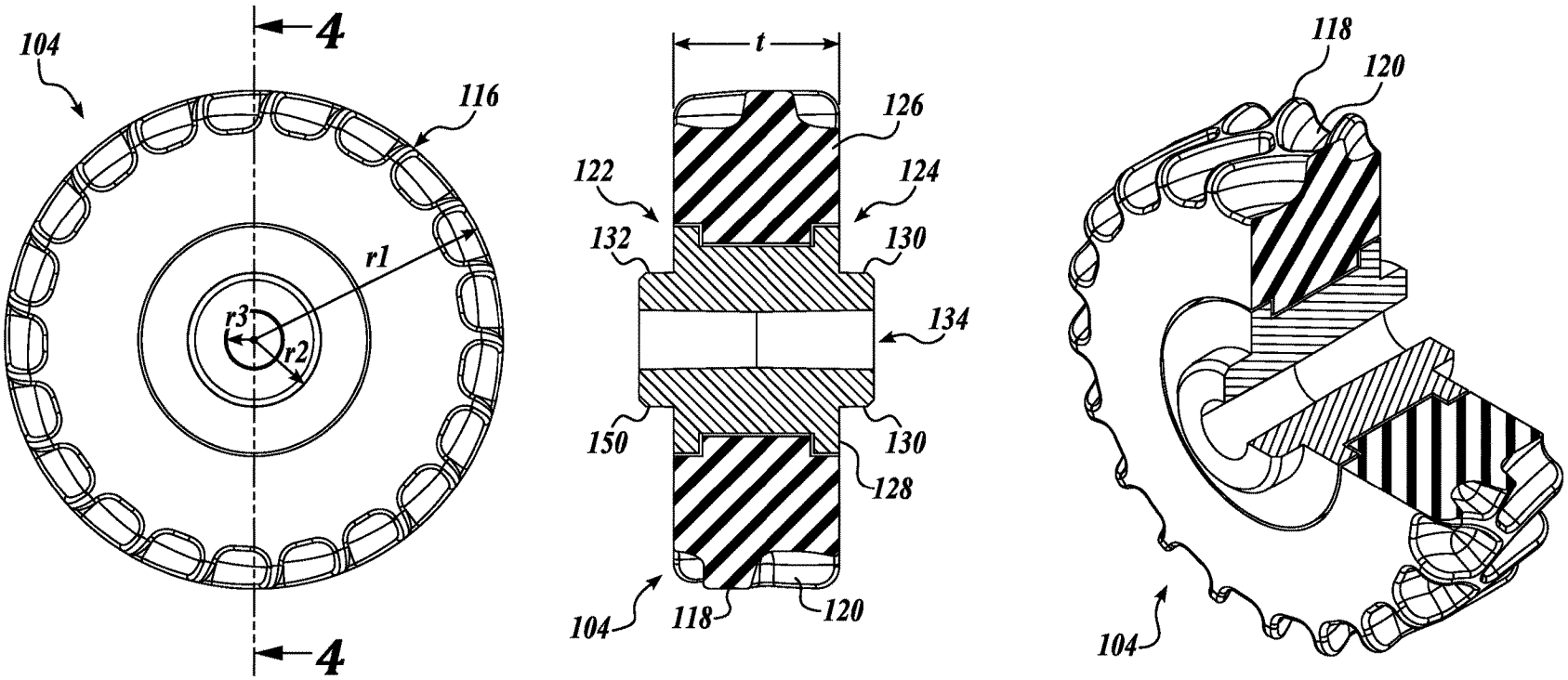
FIG. 3
FIG. 4
FIG. 5

MAKEUP APPLICATOR TO DEPOSIT A PATTERNED AND TEXTURED MAKEUP LAYER

SUMMARY

There are relatively few utensils for applying cosmetics. Application utensils generally fall in the category of brushes, sponges, woven pads, and the like. These current application utensils are loaded with the cosmetic, and then applied to the skin in generally regular, uniform strokes. The application of cosmetics in this matter results in a uniform effect. The current cosmetic application utensils do not allow for creating types of patterns, other than the generally uniform pattern, without effort. For example, one might have incentive to create non-uniform patterns with a brush. However, this is time-consuming and not everyone has the skill to create artistic designs with the current cosmetic application utensils.

In one embodiment, an application utensil comprises a wheel comprising a pattern of raised and submerged regions on an outer tread surface of the wheel; a wheel well that supports the wheel and allows rotation of the wheel, wherein the wheel is removable from the wheel well; and a manual grip connected to the wheel well.

In one embodiment, the manual grip comprises an elongated handle or at least one finger ring.

In one embodiment, the outer tread surface bulges radially outward.

In one embodiment, the outer tread surface is depressed radially inward.

In one embodiment, the wheel includes a tread portion of an elastomeric material surrounding a hub portion of a harder material than the elastomeric material.

In one embodiment, the wheel well comprises a first and second fork connected to each other at a crown, wherein the first and second forks are flexible to allow the wheel to be removed.

In one embodiment, the wheel well comprises a first and second fork connected to each other at a crown, wherein the first and second fork are placed opposite to each other, and inner facing surfaces of the forks have a first flat surface, and a perpendicular circular hole in the first flat surface of each fork.

In one embodiment, the perpendicular circular hole is connected to a radial opening, wherein the opening follows a first and second tangential line of the perpendicular circular hole and a detent in the shape of an arc is placed in the opening, wherein the detent matches the circumference of the perpendicular circular hole.

In one embodiment, the wheel comprises an axle fixed to the center of the wheel and the axle fits into the perpendicular circular hole of each fork.

In one embodiment, the wheel comprises a central hub having an axle projecting outward from each side of the hub.

In one embodiment, the outer thread surface of the wheel is loaded with a coloring composition.

In one embodiment, a diameter to thickness ratio of the wheel is greater than 1.

In one embodiment, a diameter to thickness ratio of the wheel is less than 1.

In one embodiment, the wheel includes a section of a sphere or ovoid.

In one embodiment, a combination, comprises an application utensil having a wheel well that is configured to accept a plurality of wheels; and one or more wheels configured to fit in the wheel well, wherein the one or more wheels have an outer tread surface pattern, wherein the application utensil and the one or more wheels are in a package.

In one embodiment, the combination further comprises a cushion compact, wherein the cushion compact includes an absorbent material wetted with a coloring composition.

In one embodiment, the combination comprises more than one wheel, where each wheel has a different outer tread surface pattern.

In one embodiment, the one or more wheels are separate from the application utensil in the package.

In one embodiment, the application utensil comprises a wheel well that is configured to support one wheel at a time and allows rotation of the wheel, wherein the wheel is removable from the wheel well; and a manual grip connected to the wheel well.

In one embodiment, a method of making an application utensil, comprises providing a wheel well that is configured to support one wheel at a time and allows rotation of the wheel, wherein the wheel is removable from the wheel well, and has a manual grip connected to the wheel well; providing a wheel comprising a pattern of raised and submerged regions on an outer tread surface of the wheel; and placing the wheel into the wheel well.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 2 is a diagrammatical illustration of the application utensil without a wheel of FIG. 1;

FIG. 3 is a diagrammatical illustration of a wheel according to one embodiment;

FIG. 4 is a diagrammatical cross-sectional illustration of the wheel of FIG. 3;

FIG. 5 is a diagrammatical cross-sectional illustration of the wheel of FIG. 3;

DETAILED DESCRIPTION

Figure 1:
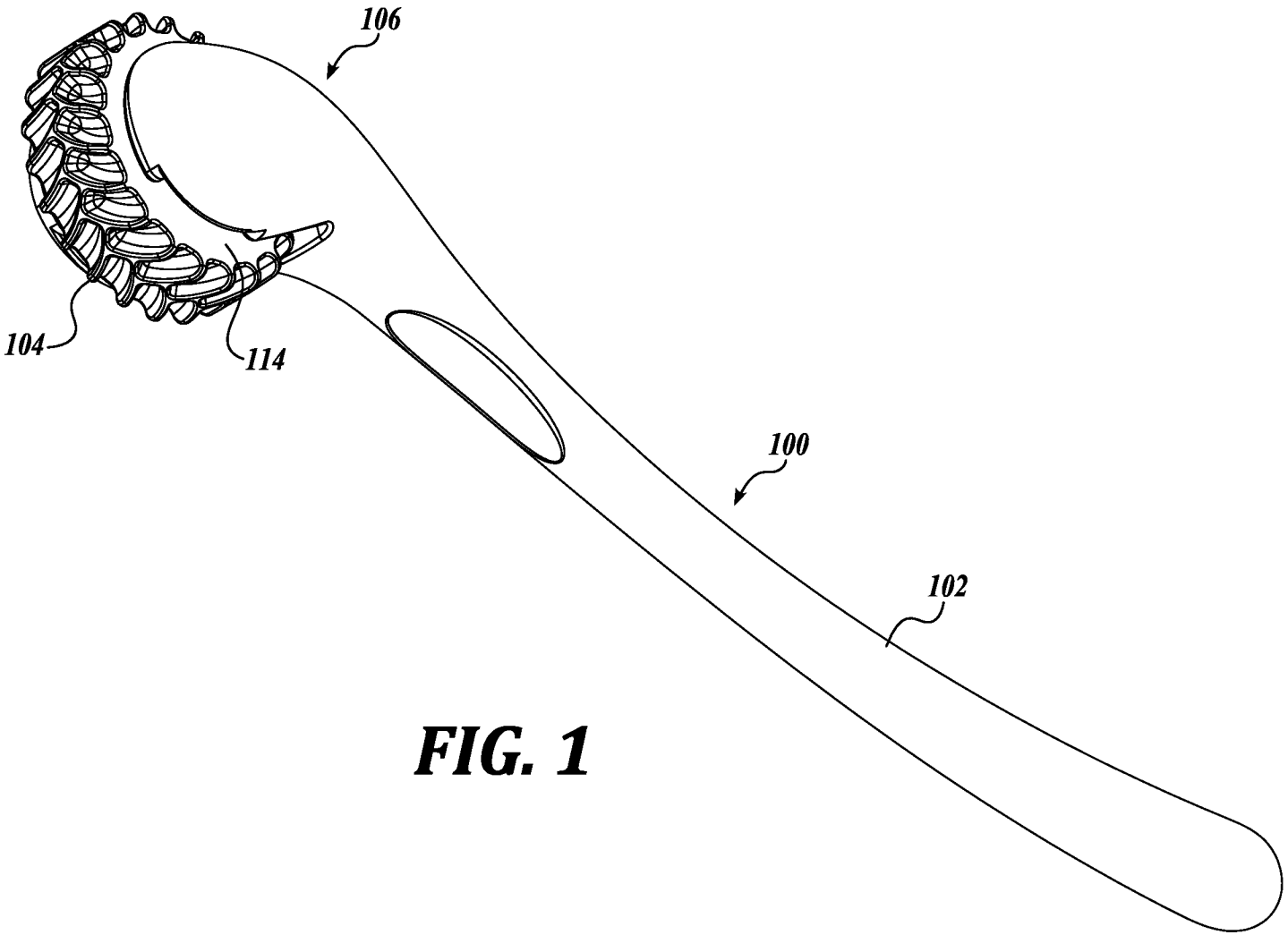
FIG. 1 is a diagrammatical illustration of an application utensil according to one embodiment.

Referring to FIG. 1, an application utensil 100 is illustrated. In one embodiment, the application utensil 100 is used for applying a coloring composition to skin. In one embodiment, the application utensil 100 includes a handle 102 (also referred to as grip 102) for manually gripping the application utensil 100. In one embodiment, the handle 102 can be straight. In one embodiment, the handle 102 can be bent or arched. The cross-sectional shape of the handle 102 can be square, rectangular, circular, or oval, or have a combination of cross-sectional shapes along the length. Although an elongated handle 102 is shown in one embodiment of the application utensil 100, the application utensil 100 can have other manual grips besides a handle. For example, a manual grip can include a finger sleeve or ring that slips over a finger, and the application utensil becomes an extension of a finger. A "grip" denotes both the handle 102 and other structures for manually gripping the utensil, such as a finger sleeve and finger ring.

The application utensil 100 includes a wheel 104 attached within a wheel well 106. In the illustrated embodiment, the wheel well 106 is formed or connected at one end of the handle 102. As used herein, "wheel well" is a structure within which the wheel 104 fits and held in place while allowing the wheel 104 to rotate. In one embodiment, the wheel well 106 is configured to support one wheel 104 at a time and allows rotation of the wheel 104.

Referring to FIG. 2, in one embodiment, the wheel well 106 includes a forked structure having a first 108 and second 110 fork which come together at the fork crown 112. The crown 112 in turn is connected to the handle 102. The first 108 and second 110 forks are spaced apart to allow room for the wheel 104 to fit between the first 108 and second 110 forks. Further, as shown in FIG. 1, the forks 108 and 110 are generally circular when viewed side on and cover the majority of the sides of the wheel 104. In one embodiment, the forks 108, 110 are smaller than the wheel 104 to allow a sidewall 114 of the wheel 104 to be exposed. This allows the wheel 104 to be rolled over skin, for example, without the forks 108, 110 rubbing on the skin. Naturally, the sidewall 114 of the wheel 104 is fully covered by the forks 108, 110 in the area where the forks 108, 110 are connected to the crown 112. Where the sidewall 114 of the wheel 104 is exposed renders that area suitable for facing the skin surface when rolling over the skin surface. In an embodiment, the forks 108 and 110 cover the majority of the side of the wheel 104 by having a radius less than the radius of the wheel 104. While the illustrated forks 108, 110 are generally flat, other embodiments of the application utensil can have different shaped forks, such as rods.

In one embodiment, the wheel well 106 can have a single fork. In the illustrated embodiment, the forks 108 and 110 used to retain the wheel 104 in place are blade shaped and thin relative to the thickness of the wheel 104.

Figure 12A:
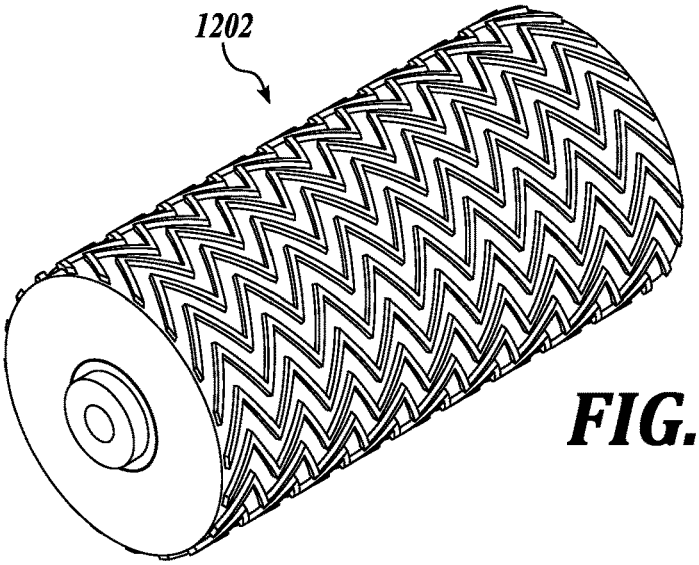
FIG. 12A is a diagrammatical illustration of a wheel according to one embodiment.
Figure 12B:
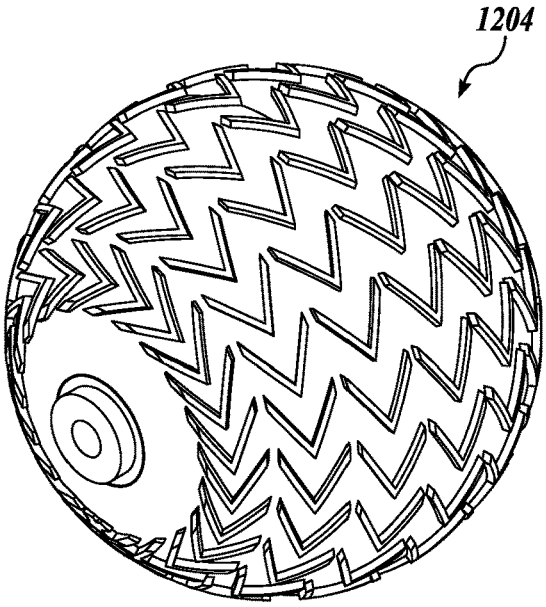
FIG. 12B is a diagrammatical illustration of a wheel according to one embodiment.
Figure 12C:
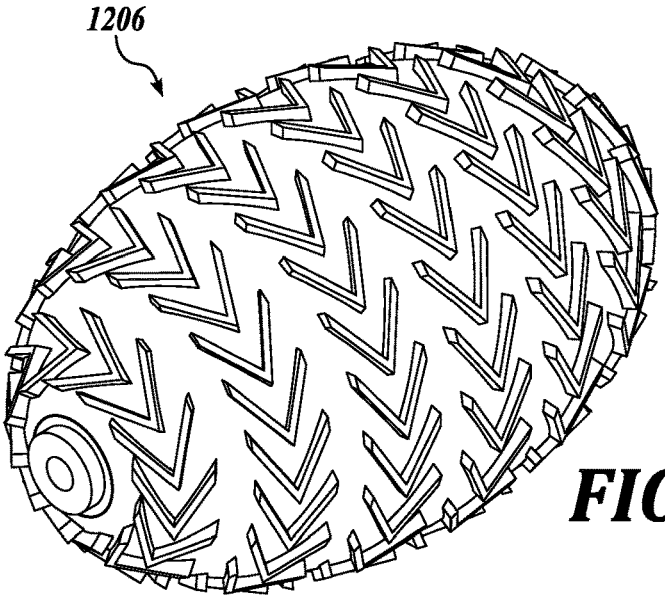
FIG. 12C is a diagrammatical illustration of a wheel according to one embodiment.

Referring to FIGS. 3, 4, and 5 one embodiment of the wheel 104 is illustrated. From FIG. 4, the wheel 104 has a first 122 and 124 second side that are parallel to each other. The wheel 104 is placed in the wheel well 106 so that the first 122 and second 124 sides respectively face the inboard sides of the first 108 and second 110 forks. The wheel 104 has a circular perimeter surface or outer tread 116 of radius r1 and thickness t. The outer tread 116 surface is comprised of raised portions 118 and submerged portions 120 in between the raised portions 118. A pattern of raised 118 and submerged 120 portions is repeated along the circumference of the outer tread surface 116. The raised portions 118 are what define the pattern that is produced by the wheel 104. In one embodiment, the radius r1 at each point along the thickness of the tread 116 is constant from one side 122 to the other perpendicular side 124. In one embodiment, the radius r1 at each point along the thickness of the tread 116 is constant from one side 122 to the other perpendicular side 124, except at the margins of the thickness where the radius can gradually be reduced. In one embodiment, the radius r1 at each point along the thickness of the tread 116 is not constant from one side 122 to the other perpendicular side 124. In one embodiment, the radius r1 may increase in the center of the thickness so that the tread 116 bulges radially outward in the middle by having a larger radius in the center of the tread 116 as compared to the radius at the edges of the thickness. When the tread 116 radius is different along the thickness direction, the tread 116 is considered to have a "draft." In one embodiment, the wheel has a diameter to thickness ratio (2r1 to t) greater than 1. In other embodiment, the diameter to thickness ratio (2r1 to t) is not greater than 1. A wheel where the diameter to thickness ratio is not greater than, i.e., less than 1, is shown as wheel 1202 in FIG. 12A. The wheel 1202 is sometimes referred to as a roller, because the thickness along the axial direction is greater than the diameter. Further, as shown in FIG. 12B, the wheel 1204 is also provided in one embodiment as a sphere, or includes a sphere truncated at the axial ends. Further, as shown in FIG. 12C, the wheel 1206 is provided as an oblong sphere or ovoid. Wheels 1202, 1204, and 1206 of FIGS. 12A, 12B, and 12C also have a pattern of raised portions and submerged portions on the outer tread surface of the respective wheel so as to be able to create patterns on skin surfaces. Wheels 1202, 1204, and 1206 as illustrated in FIGS. 12A, 12B, and 12C are used in place of the wheel 104. To accommodate wheels 104, 1202, 1204, and 1206, the application utensil 100 has a single fork to accommodate wheels of varying thickness. In other embodiments, the application utensil 100 has two opposite forks spaced apart to accommodate a particular wheel thickness. In other embodiments, a particular wheel and wheel well is provided as a replaceable attachment. For example, wheels 104, 1202, 1204, and 1206 are each provided with their own wheel well, and each particular wheel well is attachable to the same common handle 102. The construction of wheels 1202, 1204, and 1206 is substantially similar to the construction described herein below for wheel 104.

Referring to FIG. 3, the wheel 104 comprises an outer tread section 126 from radius r1 to radius r2, and an inner hub section 128 from radius r2 to radius r3. In one embodiment, the tread section 126 is made from a different material than the hub section 128. For example, in one embodiment, the tread section 126 is made from an elastomer and the hub section 128 is made from a rigid, harder plastic compared to the tread section 126. The tread section 126 material, which also includes the outer tread 116, is for loading with a coloring composition for example, and can have some amount of deformation when pressure is applied, while the hub section 128 material serves as an axle for centering the wheel 104 in the wheel well 106 and for allowing rotation with reduced friction.

Referring to FIG. 4, the wheel 104, and particularly the hub section 128 includes a first stub axle 132 on the first side 122 and a second stub axle 130 on the second side 124. The stub axles 132, 134 are radially centered in the wheel 104 and extend axially in the respective side direction. Further, the stub axles 132, 130 are fixed to the hub section 128, and the hub section 128 is also fixed relative to the tread section 126. Therefore, the stub axles 132, 134 rotate with rotation of the wheel 104. The stub axles 132, 130 fit into corresponding holes on the inside facing surface of the forks 108, 110.

In the illustrated embodiment, the wheel 104 is provided with stub axles 132, 130 that fit into corresponding holes to allow rotation. However, other axle configurations are contemplated to allow rotation. In one embodiment, instead of stub axles 132, 130, a straight axle is used for both sides of the wheel 104.

In one embodiment, the wheel 104 has a hole of radius r3 at its radial center. The hole can traverse the entire thickness of the wheel 104 from side 122 to side 124. In one embodiment, the forks 108, 110 have a hole of similar radius, and a metal or plastic pin is passed through holes in the forks 108, 110 and wheel 106. In this case, the wheel 104 can rotate relative to the pin, or the pin is fixed to the wheel, and the pin rotates on the forks 108, 110.

Alternatively, in another embodiment, the wheel 104 includes a first hole on the first side 122 and a second hole on the second opposite parallel side 124, where the first and second holes are placed in the center of the wheel 104. In such case, the wheel 104 is held in the wheel well 106 with a first and second stub axle projecting inward from the first 108 and second 110 fork. In this case, as with the illustrated embodiment, the forks 108 and 110 can be flexible to allow the forks 108, 110 to be spread apart allowing the wheel 104 to snap into place when the holes on the wheel fall into the stub axles on the forks 108, 110.

Referring to FIG. 5, a representative outer tread surface pattern is illustrated where the ridges 118 (raised portions) are separated from each other by submerged regions 120. The ridges 118 can be arranged in a variety of patterns. During the loading of the coloring composition onto the wheel 104, the coloring composition can wick into the submerged regions 120 where it will stay due to surface tension. The coloring composition will also spread onto the tops of the ridges 118. When the application utensil is then applied onto skin, the coloring composition will be transferred from the ridges 118 to the skin, and the coloring composition will be continually replenished from the submerged regions 120.

Figure 6:
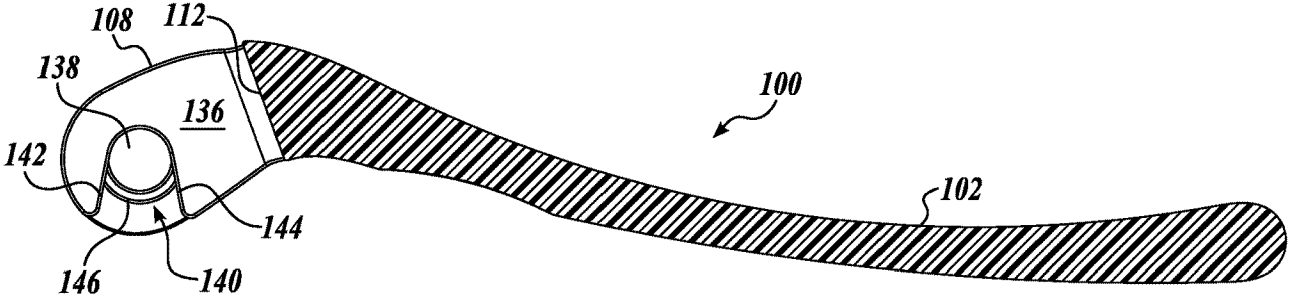
FIG. 6 is a diagrammatical cross-sectional illustration of the application utensil without wheel of FIG. 2.

Referring to FIG. 6, a cross section of the application utensil 100 without the wheel is shown exposing the inward facing surface of the fork 108. It is to be understood that the second fork 100 is a mirror image of the first fork 108. The wheel well 106 includes the first 108 and second 110 fork connected to each other at a crown 112, wherein the first 108 and second 110 fork are placed opposite and/or parallel to each other. As shown in FIG. 6, the inner facing surfaces of the forks 108, 110 have a first flat surface 136. A perpendicular circular hole 138 is provided in the first flat surface 136 of each fork 108, 110. The hole 138 can be bored through the entire fork 108 or only part way through the fork 108. In any case, the radius of the hole 138 is sized so that the stub axle 132 will fit therein loosely to enable rotation. Further, the hole 138 opens into to a radial groove opening 140 cut into the flat surface 136, wherein the opening 140 follows a first 142 and second 144 tangential line of the circular hole 136. A detent 146 in the shape of an arc is placed in the opening 140, wherein the detent 146 matches the circumference of the circular hole 138. The groove openings 140 in both the first 108 and second 110 fork are used to allow insertion and removal of the wheel 104 from the wheel well 106. The detent 146 is used to hold the wheel 104 in the hole 138 of the wheel well 106 without falling out through the groove opening 140. In another embodiment, instead of having tangential lines 142, 144 defining the groove opening 140, the opening can be a keyhole shape comprising a circular hole and a portion of a triangle extending therefrom. In the case where the groove opening 140 is shaped as a keyhole, the radial detent 146 is replaced by oppositely placed detents forming the narrow portion of the keyhole. In some embodiments, the stub axles 130, 132 will also be flexible to allow the stub axles 130, 132 to be inserted past the detent 146 and fitted inside the respective holes on the forks 108, 110.

Figure 7:
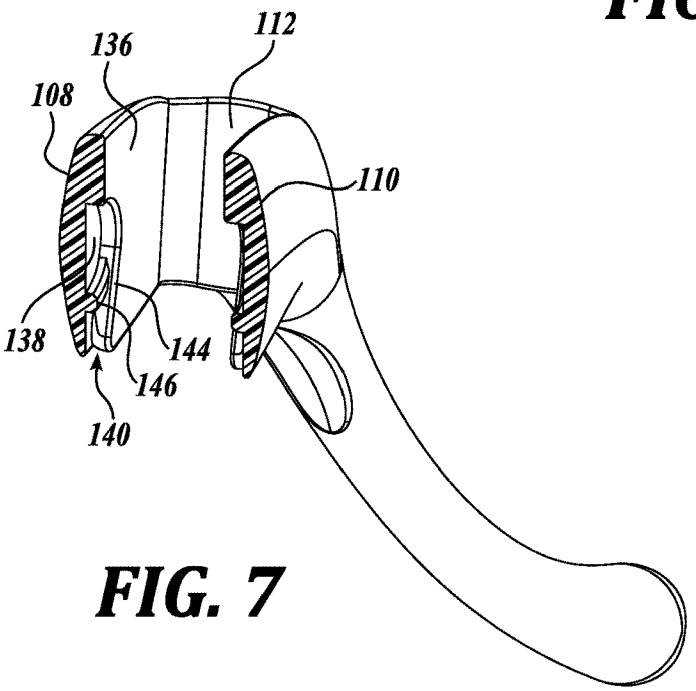
FIG. 7 is a diagrammatical cross-sectional illustration of an application utensil without wheel of FIG. 2.

In FIG. 7, a cross section of the wheel well 106 through both forks 108, 110, shows the detent 146 as a bump with beveled edges to allow the entry and exit of the wheel 104. The detent 146 also extends from tangent line 142 to tangent line 144, and the detent 146 is placed on the groove opening 140 surface, not on the first flat surface 136. In one embodiment, the height of the detent 146 from the groove opening 140 surface does not reach to the first flat surface 136. As can also be seen, in one embodiment, the depth of the hole 138 corresponds to the depth of the groove opening 140 surface. Rounded corners 148 and 150 (FIG. 4) are also provided on the outer edges of the stub axles 130, 132 to allow for easier insertion and removal. In another embodiment, the detent 146 cross section can be a semi-circular shape.

Figure 8:
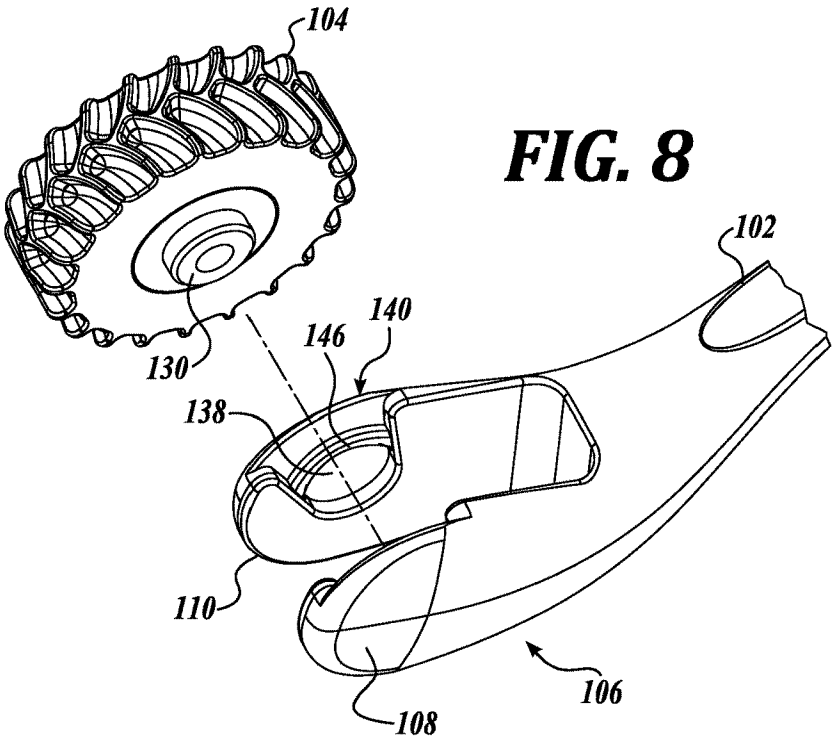
FIG. 8 is a diagrammatical exploded view illustration of the wheel from the application utensil.

FIG. 8 shows an illustration of inserting and/or removing the wheel 104 from the wheel well 106. Generally, when inserting the wheel 104, the wheel 104 is positioned so that the stub axles 130, 132 are aligned with the groove openings 140 on the respective forks 108, 110. When the stub axles 130, 132 hit upon the detent 146 resistance to further movement occurs, and a small amount of pressure will cause the forks 108, 110 to separate overcoming the resistance allowing further inward movement of the wheel 104 so that the stub axles 130, 132 come to rest inside the respective holes 138. The removal of the wheel 104 from the wheel well 106 is carried out by reversing the direction of pulling on the wheel 104 from the wheel well 106. Generally, aligning the stub axles 130, 132 with the groove opening 140 is the simplest manner of inserting or removing the wheel 104 offering the least resistance. However, because the forks 108, 110 are flexible, in some embodiments, the wheel 104 can be forced in or out from the wheel well 106 even though the stub axles 130, 132 are not aligned with the groove opening 140. While one embodiment of a wheel 104 that is removable from the wheel well 106 of the application utensil 100 is shown, other embodiments for attaching a removable wheel 104 are possible and within the scope of this disclosure.

Figure 9:
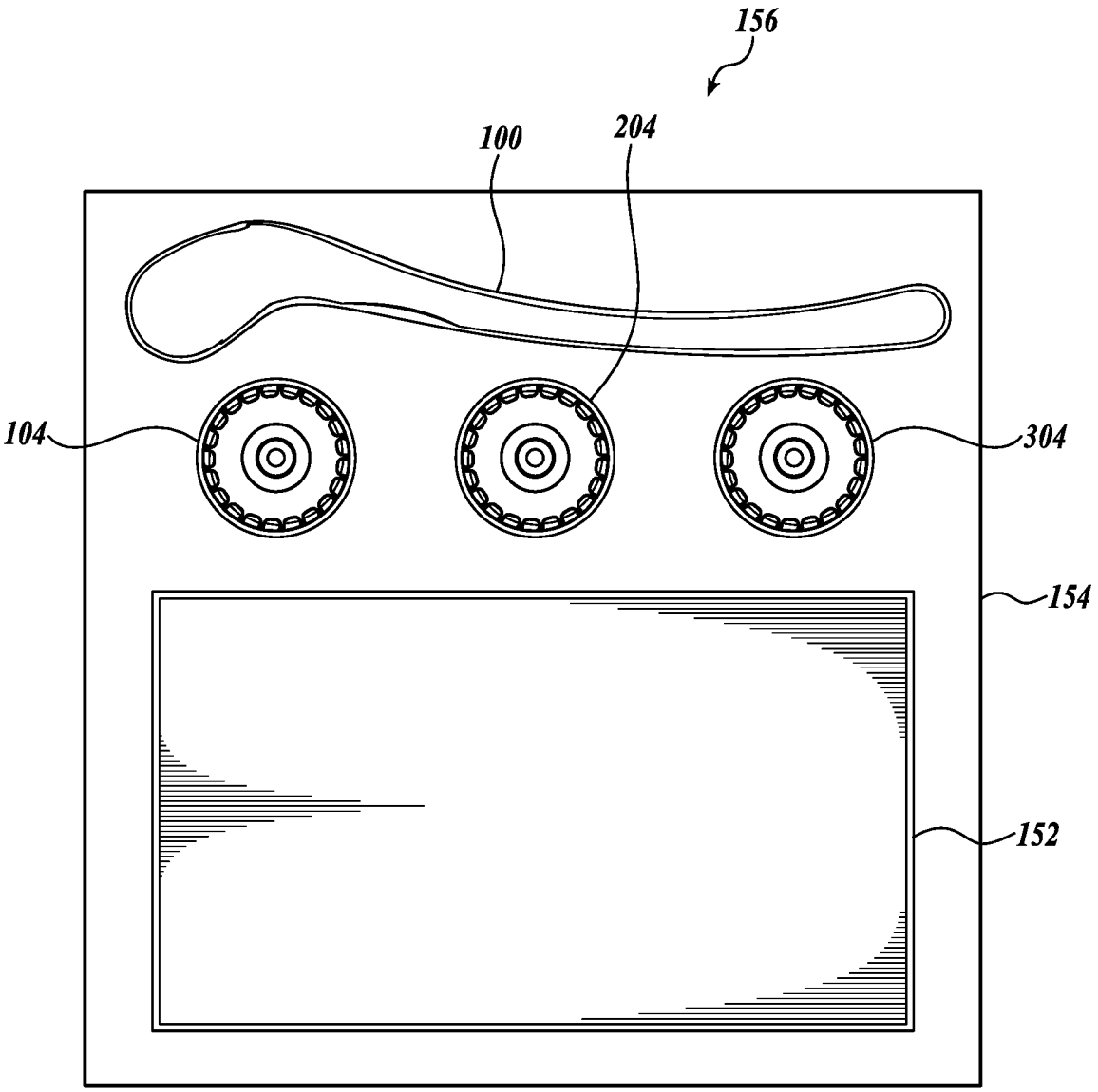
FIG. 9 is a diagrammatical illustration of a packaged combination of an application utensil, a plurality of wheels, and a cushion compact according to one embodiment.

FIG. 9 shows a combination 156 of an application utensil 100 without a wheel, a plurality of wheels 104, 204, and 304, and an optional cushion compact 152, wherein the components are packaged as a unit 154. The application utensil 100 is only representative. Any application utensil described herein is suitable to be used in the combination 156. A cushion compact 152 is used for containing a coloring composition. In one embodiment, a "cushion compact" includes a container, usually a body having some depth to fit an absorbent medium, such as a sponge, which is soaked with a coloring composition, and a lid to prevent spillage or drying when not being used. The combination 156 further includes packaging 154, such as a box, shrink wrapping, or molded plastic to hold the application utensil 100 without a wheel, the plurality of wheels 104, 204, and 304, and the optional cushion compact 152 together for sale as a retail unit. As mentioned already, application utensils can come in different styles and have different grips. Wheels can be provided having a variety of outer tread surface patterns, and coloring compositions can be provided in a variety of colors or a variety of types of compositions. In one embodiment, the one or more wheels 104, 204, and 304 are separate from the application utensil 100 in the package 154. In one embodiment, the application utensil 100 comprises a wheel well that is configured to support one wheel at a time and allows rotation of the wheel, wherein the wheel is removable from the wheel well; and a manual grip connected to the wheel well.

In another embodiment, the application utensil 100 without a wheel is provided as a separate packaged item for retail sale, each of the plurality of wheels 104, 204, and 304 are provided as separate packaged items for retail sale, and the cushion compact 152 is provided as a separate packaged item for retail sale. This allows the ultimate purchaser or user of the components to select and mix and match application utensils, wheels, and cushion compacts. In another embodiment, different wheel shapes as shown in FIGS. 12A, 12B, and 12C are also offered as an option for selection by the ultimate purchaser/user. In still other embodiments, different wheel shapes, each provided in its own wheel well are supplied with a handle, wherein each wheel well can attach and detach from the handle.

Figure 10:
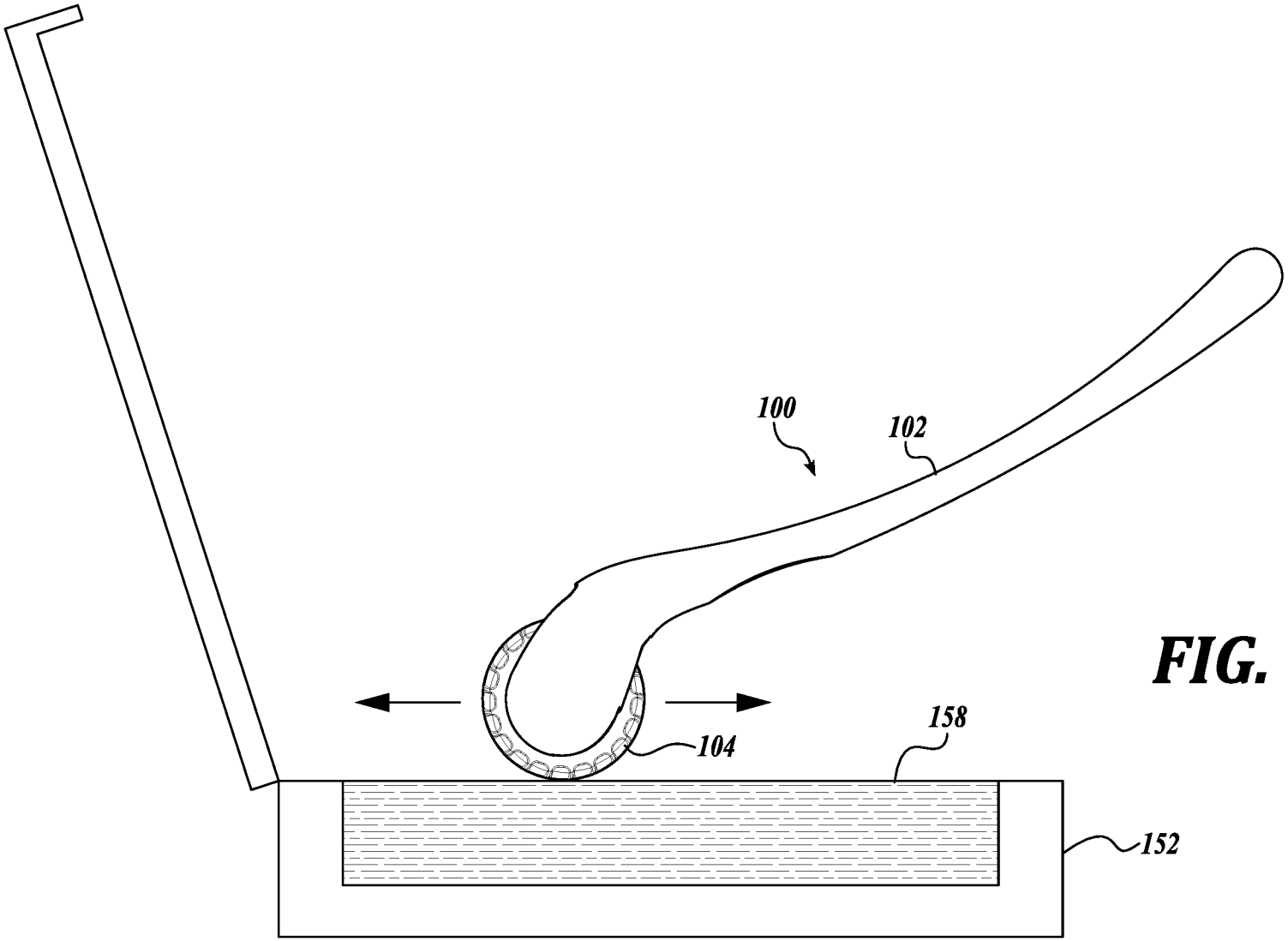
FIG. 10 is a diagrammatical illustration of the step of loading a coloring composition on the wheel of the application utensil according to one embodiment.
Figure 11:
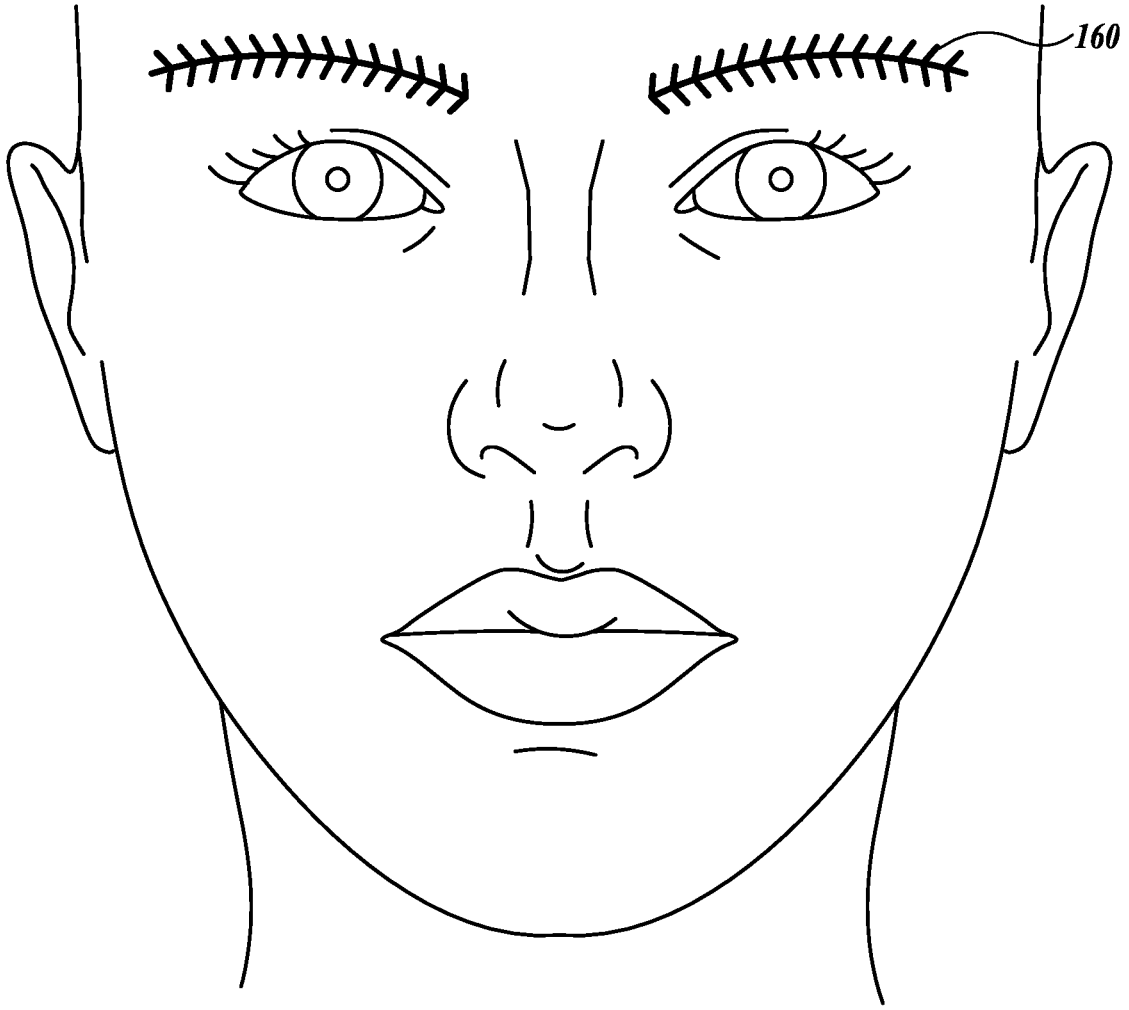
FIG. 11 is a diagrammatical illustration of a coloring composition applied in a pattern on eyebrows using the application utensil.

FIG. 10 illustrates the loading of a coloring composition onto the wheel 104 of the application utensil 100. As described above, the cushion compact 152 includes an absorbent medium 158, such as a sponge, that is wetted with a coloring composition. In one embodiment, the coloring composition is a liquid. In one embodiment, the coloring composition is a solid. Coloring compositions are generally composed of oils, waxes, water, powders, pigments, dyes, bases, and the like. Representative solid powders, include, but are not limited to, metal oxides, talc, kaolin, zinc white, titanium white, calcium carbonate, magnesium carbonate, carbon black, iron tetratrioxide, yellow ocher, red iron oxide, and the like. The coloring composition is generally loaded onto the wheel 104 by employing a back and forth motion rotating the wheel 104 through 360 degrees to allow the entire circumference of the outer tread of the wheel 104 to be loaded with coloring composition. Thereafter, the application utensil 100 is rolled over a portion of skin, such as the eyebrow area, for example, while applying enough pressure to transfer the coloring composition in the pattern on the wheel 104 to the skin in a similar pattern 160, as illustrated in FIG. 11.

Figure 13:
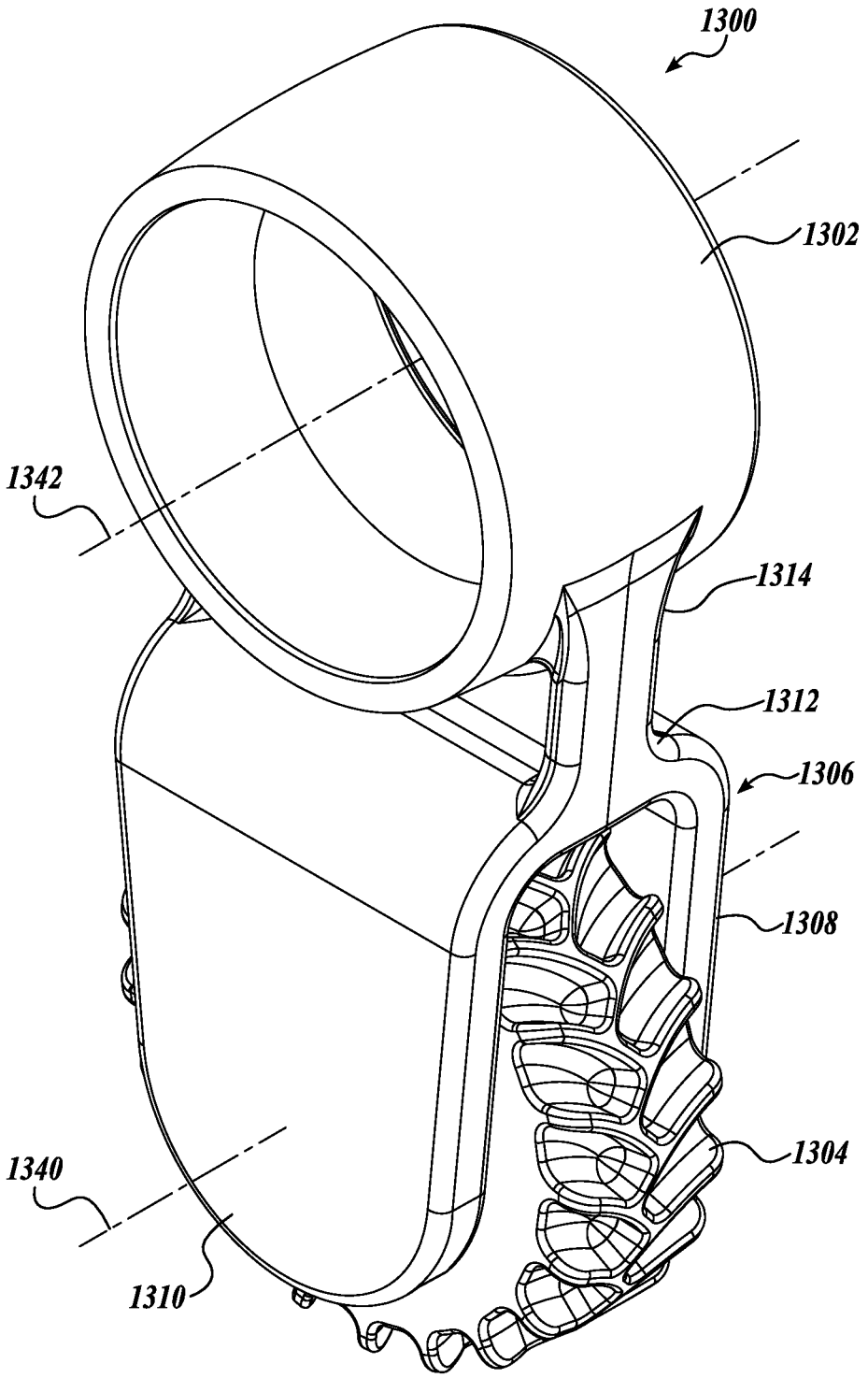
FIG. 13 is a diagrammatical illustration of an application utensil according to one embodiment.

Referring to FIG. 13, an application utensil 1300 is illustrated. In one embodiment, the application utensil 1300 is used for applying a coloring composition to skin. In one embodiment, the application utensil 1300 includes a finger ring 1302 (also referred to as grip 1302) for manually gripping the application utensil 1300. As compared to the embodiment of FIG. 1, FIG. 13 illustrates an application utensil 1300 with a grip 1302 being a finger ring 1302. With the exception of the grip 1302 being a finger ring as opposed to handle, the application utensil 1300 uses similar wheels and has a similar wheel well structure as described for the embodiment of FIG. 1. The application utensil 1300 is also suitable to be used in the combination 156 of FIG. 9, and for the use of applying a coloring composition as described in FIGS. 10 and 11.

Referring to FIG. 13, in one embodiment, the wheel well 1306 includes a forked structure having a first 1308 and second 1310 fork which come together at the fork crown 1312. The crown 1312 in turn is connected to the finger ring 1302 via a connecting rod 1314. The first 1308 and second 1310 forks are spaced apart to allow room for the wheel 1304 to fit between the first 1308 and second 1310 forks. Further, as shown in FIG. 13, the forks 1308 and 1310 are generally circular when viewed side-on and cover the majority of the sides of the wheel 1304. In one embodiment, the forks 1308, 1310 are smaller than the wheel 1304 to allow a sidewall of the wheel 1304 to be exposed. This allows the wheel 1304 fitted to wheel well 1306 to be rolled over skin, for example, without the forks 1308, 1310 rubbing on the skin.

In one embodiment, the wheel 1304 connected to wheel well 1306 is removable from the wheel well 1306. In one embodiment, the forks 1308, 1310 are flexible that allow removing a wheel. The structure connecting the wheel 1304 to the wheel well 1306 is any structure described or illustrated herein, including, for example, the structure as described in association with FIGS. 6-8. In one embodiment, the forks 1308, 1310 are placed opposite to each other, and inner facing surfaces of the forks 1308, 1310 have a first flat surface, and a perpendicular circular hole in the first flat surface of each fork to allow a stub axle of a wheel to fit therein.

The grip 1302 is a finger ring 1302. The finger ring 1302 is provided in various sizes. Sizes can correlate to a certain inside diameter to allow a finger, such as index, middle, ring, thumb, or pinky finger to fit into the finger ring 1302. As with other grips, the finger ring 1302 is for manually gripping the application utensil 1300 when loading a coloring composition onto a wheel and when applying the coloring composition. The gauge of the band comprising the finger ring 1302 is available in various thicknesses. The finger ring 1302 band is available in various axial lengths.

The direction of travel of the wheel 1304 in the wheel well 1306 is perpendicular to an axial center 1342 of the finger ring 1302, and therefore, the axis of rotation 1340 of the wheel 1304 in the wheel well 1306 is parallel to the axial center 1342 of the finger ring 1302.

Figure 14:
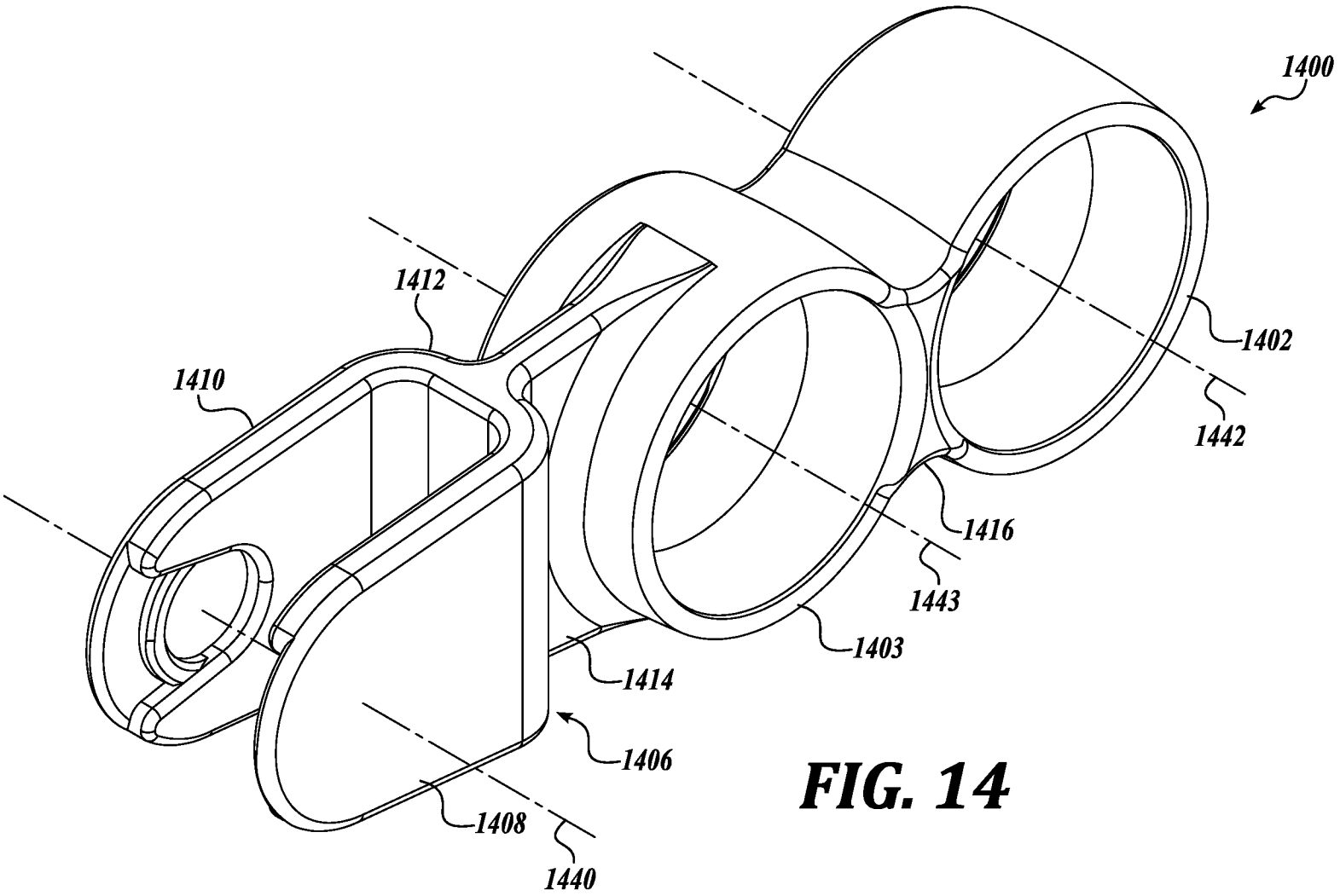
FIG. 14 is a diagrammatical illustration of an application utensil according to one embodiment.

Referring to FIG. 14, an application utensil 1400 is illustrated. In one embodiment, the application utensil 1400 is used for applying a coloring composition to skin. In one embodiment, the application utensil 1400 includes a first finger ring 1403 and a second finger ring 1402 (also referred to as grip) for manually gripping the application utensil 1400. As compared to the embodiment of FIG. 1, FIG. 14 illustrates an application utensil 1400 with a grip being a first 1403 and second 1402 finger ring. With the exception of the grip being two finger rings as opposed to a handle, the application utensil 1400 uses similar wheels and has a similar wheel well structure as described for the embodiment of FIG. 1. The application utensil 1400 is also suitable to be used in the combination 156 of FIG. 9, and for the use of applying a coloring composition as described in FIGS. 10 and 11.

Referring to FIG. 14, in one embodiment, the wheel well 1406 includes a forked structure having a first 1408 and second 1410 fork which come together at the fork crown 1412. The crown 1412 in turn is connected to the finger ring 1403 via a first connecting rod 1414. The first finger ring 1403 is connected to the second finger ring 1402 via a second connecting rod 1416. The first 1408 and second 1410 forks are spaced apart to allow room for any of the wheels to fit between the first 1408 and second 1410 forks. Further, as shown in FIG. 14, the forks 1408 and 1410 are generally circular when viewed side on and cover the majority of the sides of a wheel. In one embodiment, the forks 1408, 1410 are smaller than a wheel to allow a sidewall of the wheel to be exposed. This allows the wheel fitted to wheel well 1406 to be rolled over skin, for example, without the forks 1408, 1410 rubbing on the skin.

A wheel is not illustrated in FIG. 14; however, it is understood that the wheel well 1406 is configured to receive any wheel, and that the wheel in the wheel well 1406 is further configured to rotate. In one embodiment, the wheel connected to wheel well 1406 is removable from the wheel well 1406. In one embodiment, the forks 1408, 1410 are flexible that allow removing a wheel. The structure connecting a wheel to the wheel well 1406 is any structure described or illustrated herein, including, for example, the structure as described in association with FIGS. 6-8. In one embodiment, the forks 1408, 1410 are placed opposite to each other, and inner facing surfaces of the forks 1408, 1410 have a first flat surface, and a perpendicular circular hole in the first flat surface of each fork to allow a stub axle of a wheel to fit therein.

The grip includes a first 1403 and second 1402 finger ring. The finger rings 1403, 1402 are provided in various sizes. Sizes can correlate to a certain inside diameter to allow a finger, such as index, middle, ring, thumb, or pinky finger to fit into the finger rings 1403, 1402. As with other grips, the finger rings 1403, 1402 are for manually gripping the application utensil 1400 when loading a coloring composition onto a wheel and when applying the coloring composition. The gauge of the bands comprising the finger rings 1403, 1402 are available in various thicknesses. The finger rings 1403, 1402 bands are available in various axial lengths.

The direction of travel of a wheel in the wheel well 1406 is perpendicular to axial centers 1443, 1442 of the finger rings 1403, 1402, and therefore, the axis of rotation 1440 of a wheel in the wheel well 1406 is parallel to the axial centers 1443, 1442 of the finger rings 1403, 1402. Further, in one embodiment, the axis of rotation 1440 at the wheel well 1406, the axial center 1443 of the first finger ring 1403, and the axial center 1442 of the second finger ring 1402 intersect a common straight line passing through all three. In one embodiment, the axis of rotation 1440 at the wheel well 1406, the axial center 1443 of the first finger ring 1403, and the axial center 1442 of the second finger ring 1402 are in line.

Figure 15:
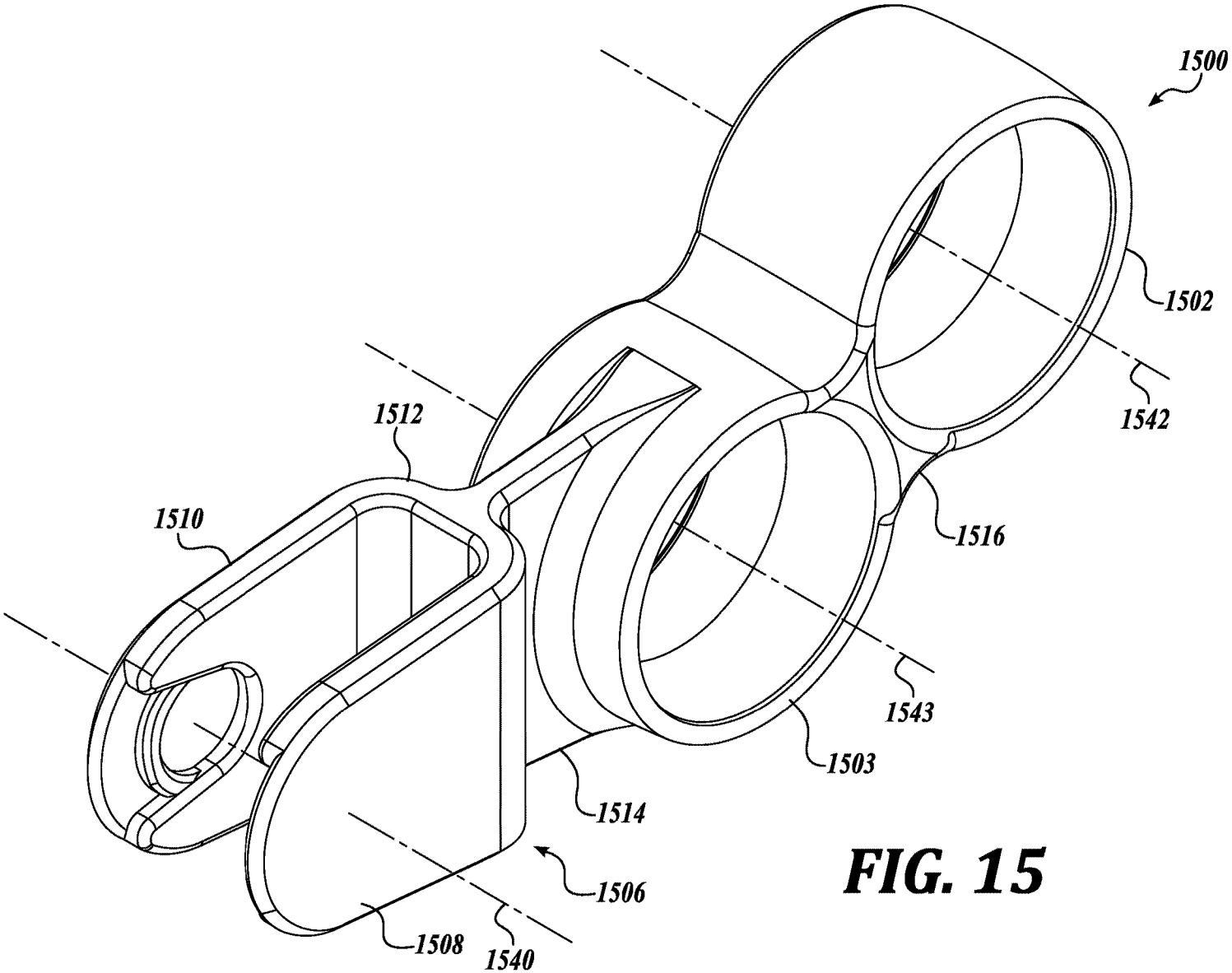
FIG. 15 is a diagrammatical illustration of an application utensil according to one embodiment.

Referring to FIG. 15, an application utensil 1500 is illustrated. In one embodiment, the application utensil 1500 is used for applying a coloring composition to skin. In one embodiment, the application utensil 1500 includes a first finger ring 1503 and a second finger ring 1502 (also referred to as grip) for manually gripping the application utensil 1500. As compared to the embodiment of FIG. 1, FIG. 15 illustrates an application utensil 1500 with a grip being a first 1503 and second 1502 finger ring. With the exception of the grip being two finger rings as opposed to a handle, the application utensil 1500 uses similar wheels and has a similar wheel well structure as described for the embodiment of FIG. 1. The application utensil 1500 is also suitable to be used in the combination 156 of FIG. 9, and for the use of applying a coloring composition as described in FIGS. 10 and 11.

Referring to FIG. 15, in one embodiment, the wheel well 1506 includes a forked structure having a first 1508 and second 1510 fork which come together at the fork crown 1512. The crown 1512 in turn is connected to the finger ring 1503 via a first connecting rod 1514. The first finger ring 1503 is connected to the second finger ring 1502 via a second connecting rod 1516. The first 1508 and second 1510 forks are spaced apart to allow room for any of the wheels to fit between the first 1508 and second 1510 forks. Further, as shown in FIG. 15, the forks 1508 and 1510 are generally circular when viewed side on and cover the majority of the sides of a wheel. In one embodiment, the forks 1508, 1510 are smaller than a wheel to allow a sidewall of the wheel to be exposed. This allows the wheel fitted to wheel well 1506 to be rolled over skin, for example, without the forks 1508, 1510 rubbing on the skin.

A wheel is not illustrated in FIG. 15; however, it is understood that the wheel well 1506 is configured to receive any wheel, and that the wheel in the wheel well 1506 is further configured to rotate. In one embodiment, the wheel connected to wheel well 1506 is removable from the wheel well 1506. In one embodiment, the forks 1508, 1510 are flexible that allow removing a wheel. The structure connecting a wheel to the wheel well 1506 is any structure described or illustrated herein, including, for example, the structure as described in association with FIGS. 6-8. In one embodiment, the forks 1508, 1510 are placed opposite to each other, and inner facing surfaces of the forks 1508, 1510 have a first flat surface, and a perpendicular circular hole in the first flat surface of each fork to allow a stub axle of a wheel to fit therein.

The grip includes a first 1503 and second 1502 finger ring. The finger rings 1503, 1502 are provided in various sizes. Sizes can correlate to a certain inside diameter to allow a finger, such as index, middle, ring, thumb, or pinky finger to fit into the finger rings 1503, 1502. As with other grips, the finger rings 1503, 1502 are for manually gripping the application utensil 1500 when loading a coloring composition onto a wheel and when applying the coloring composition. The gauge of the bands comprising the finger rings 1503, 1502 are available in various thicknesses. The finger rings 1503, 1502 bands are available in various axial lengths.

The direction of travel of a wheel in the wheel well 1506 is perpendicular to axial centers 1543, 1542 of the finger rings 1503, 1502, and therefore, the axis of rotation 1540 of a wheel in the wheel well 1506 is parallel to the axial centers 1543, 1542 of the finger rings 1503, 1502. Further, in one embodiment, the axis of rotation 1540 at the wheel well 1506 and the axial center 1543 of the first finger ring 1503 intersect a common straight line. However, the axial center 1542 of the second finger ring 1502 lies at an angle from the common straight line. In one embodiment, the axis of rotation 1540 at the wheel well 1506, the axial center 1543 of the first finger ring 1503, and the axial center 1542 of the second finger ring 1502 are not in line. However, viewed another way, the axial center 1543 of the first finger ring 1503 and the axial center 1542 of the second finger ring 1502 intersect a common straight line, where the axis of rotation 1540 at the wheel well 1506 lies at an angle from the common straight line.

Figure 16:
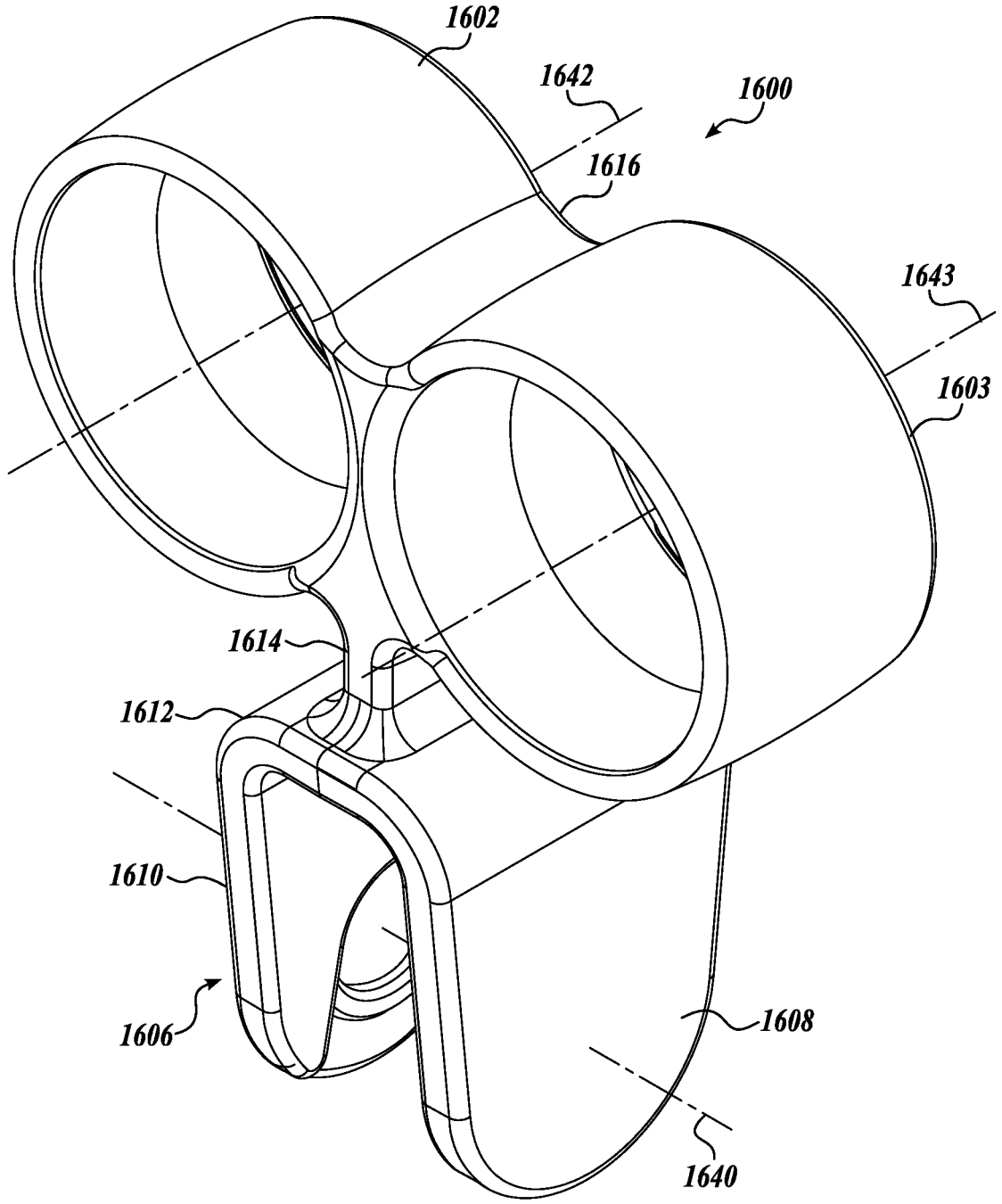
FIG. 16 is a diagrammatical illustration of an application utensil according to one embodiment.

Referring to FIG. 16, an application utensil 1600 is illustrated. In one embodiment, the application utensil 1600 is used for applying a coloring composition to skin. In one embodiment, the application utensil 1600 includes a first finger ring 1603 and a second finger ring 1602 (also referred to as grip) for manually gripping the application utensil 1600. As compared to the embodiment of FIG. 1, FIG. 16 illustrates an application utensil 1600 with a grip being a first 1603 and second 1602 finger ring. With the exception of the grip being two finger rings as opposed to a handle, the application utensil 1600 uses similar wheels and has a similar wheel well structure as described for the embodiment of FIG. 1. The application utensil 1600 is also suitable to be used in the combination 156 of FIG. 9, and for the use of applying a coloring composition as described in FIGS. 10 and 11.

Referring to FIG. 16, in one embodiment, the wheel well 1606 includes a forked structure having a first 1608 and second 1610 fork which come together at the fork crown 1612. The crown 1612 in turn is connected to the finger rings 1603, 1602 via a first connecting rod 1614. The first finger ring 1603 is connected to the second finger ring 1602 via a second connecting rod 1616. The first connecting rod 1614 is connected to the second connecting rod 1616 so that the first connecting rod 1614 is located between the first 1603 and the second 1602 finger rings. The first 1608 and second 1610 forks are spaced apart to allow room for any of the wheels to fit between the first 1608 and second 1610 forks. Further, as shown in FIG. 16, the forks 1608 and 1610 are generally circular when viewed side on and cover the majority of the sides of a wheel. In one embodiment, the forks 1608, 1610 are smaller than a wheel to allow a sidewall of the wheel to be exposed. This allows the wheel fitted to wheel well 1606 to be rolled over skin, for example, without the forks 1608, 1610 rubbing on the skin.

A wheel is not illustrated in FIG. 16; however, it is understood that the wheel well 1606 is configured to receive any wheel, and that the wheel in the wheel well 1606 is further configured to rotate. In one embodiment, the wheel connected to wheel well 1606 is removable from the wheel well 1606. In one embodiment, the forks 1608, 1610 are flexible that allow removing a wheel. The structure connecting a wheel to the wheel well 1606 is any structure described or illustrated herein, including, for example, the structure as described in association with FIGS. 6-8. In one embodiment, the forks 1608, 1610 are placed opposite to each other, and inner facing surfaces of the forks 1608, 1610 have a first flat surface, and a perpendicular circular hole in the first flat surface of each fork to allow a stub axle of a wheel to fit therein.

The grip includes a first 1603 and second 1602 finger ring. The finger rings 1603, 1602 are provided in various sizes. Sizes can correlate to a certain inside diameter to allow a finger, such as index, middle, ring, thumb, or pinky finger to fit into the finger rings 1603, 1602. As with other grips, the finger rings 1603, 1602 are for manually gripping the application utensil 1600 when loading a coloring composition onto a wheel and when applying the coloring composition. The gauge of the bands comprising the finger rings 1603, 1602 are available in various thicknesses. The finger rings 1603, 1602 bands are available in various axial lengths.

The direction of travel of a wheel in the wheel well 1606 is parallel to axial centers 1643, 1642 of the finger rings 1603, 1602, and therefore, the axis of rotation 1640 of a wheel in the wheel well 1606 is perpendicular to the axial centers 1643, 1642 of the finger rings 1603, 1602. Further, a perpendicular line drawn at the midpoint of the axis of rotation 1640 of a wheel in the wheel well 1606 together with the lines passing at the axial centers 1643, 1642 of the finger rings 1603, 1602 describe the points of a triangle, where the base of the triangle is a line connecting the axial centers 1643, 1642 of the finger rings 1603, 1602. In one embodiment, the triangle is an isosceles triangle. In one embodiment, the triangle is an equilateral triangle.

Figure 17:
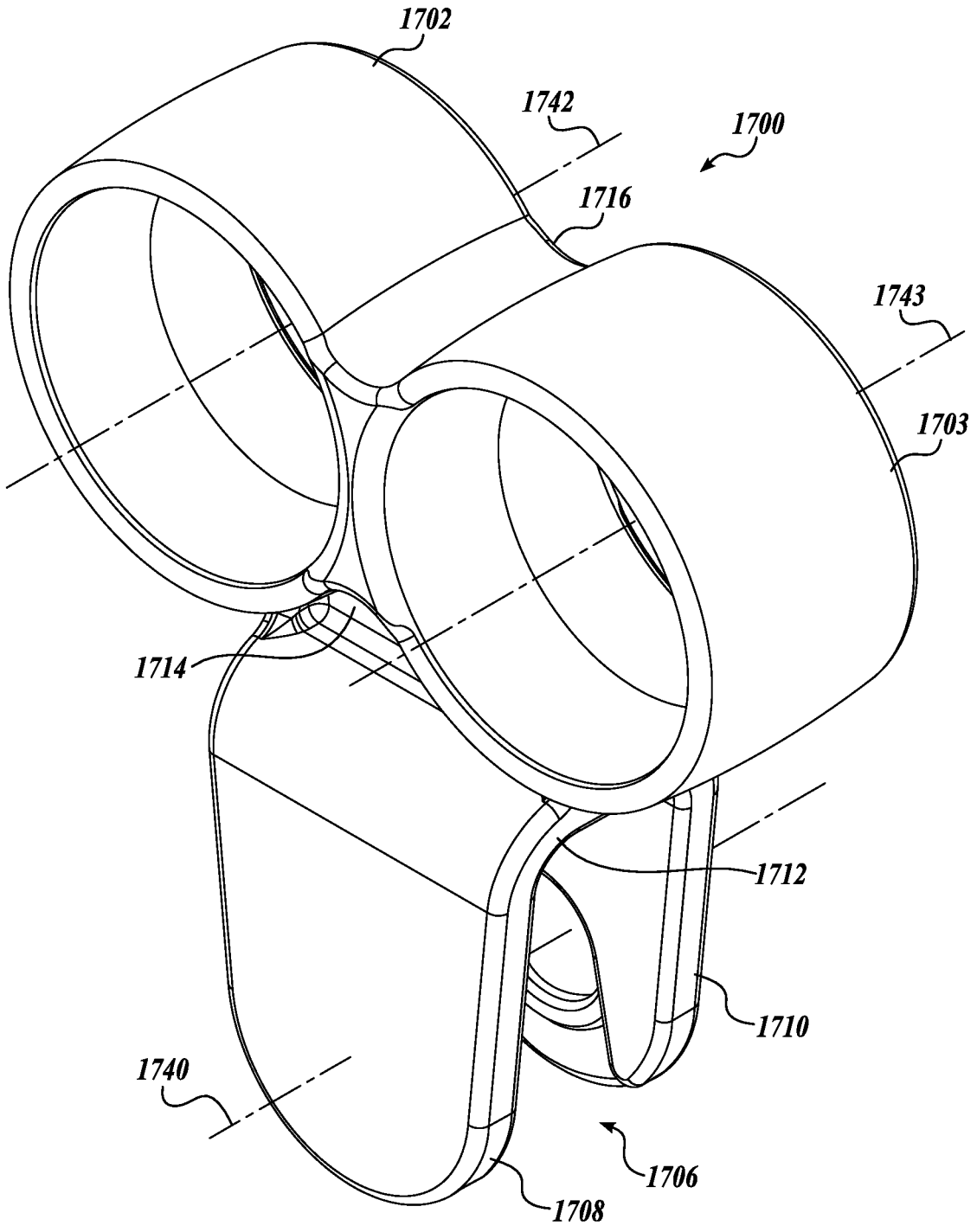
FIG. 17 is a diagrammatical illustration of an application utensil according to one embodiment.

Referring to FIG. 17, an application utensil 1700 is illustrated. In one embodiment, the application utensil 1700 is used for applying a coloring composition to skin. In one embodiment, the application utensil 1700 includes a first finger ring 1703 and a second finger ring 1702 (also referred to as grip) for manually gripping the application utensil 1700. As compared to the embodiment of FIG. 1, FIG. 17 illustrates an application utensil 1700 with a grip being a first 1703 and second 1702 finger ring. With the exception of the grip being two finger rings as opposed to a handle, the application utensil 1700 uses similar wheels and has a similar wheel well structure as described for the embodiment of FIG. 1. The application utensil 1700 is also suitable to be used in the combination 156 of FIG. 9, and for the use of applying a coloring composition as described in FIGS. 10 and 11.

Referring to FIG. 17, in one embodiment, the wheel well 1706 includes a forked structure having a first 1708 and second 1710 fork which come together at the fork crown 1712. The crown 1712 in turn is connected to the finger rings 1703, 1702 via a first connecting rod 1714. The first finger ring 1703 is connected to the second finger ring 1702 via a second connecting rod 1716. The first connecting rod 1714 is connected to the second connecting rod 1716 so that the first connecting rod 1714 is located between the first 1703 and the second 1702 finger rings. The first 1708 and second 1710 forks are spaced apart to allow room for any of the wheels to fit between the first 1708 and second 1710 forks. Further, as shown in FIG. 17, the forks 1708 and 1710 are generally circular when viewed side on and cover the majority of the sides of a wheel. In one embodiment, the forks 1708, 1710 are smaller than a wheel to allow a sidewall of the wheel to be exposed. This allows the wheel fitted to wheel well 1706 to be rolled over skin, for example, without the forks 1708, 1710 rubbing on the skin.

A wheel is not illustrated in FIG. 17; however, it is understood that the wheel well 1706 is configured to receive any wheel, and that the wheel in the wheel well 1706 is further configured to rotate. In one embodiment, the wheel connected to wheel well 1706 is removable from the wheel well 1706. In one embodiment, the forks 1708, 1710 are flexible that allow removing a wheel. The structure connecting a wheel to the wheel well 1706 is any structure described or illustrated herein, including, for example, the structure as described in association with FIGS. 6-8. In one embodiment, the forks 1708, 1710 are placed opposite to each other, and inner facing surfaces of the forks 1708, 1710 have a first flat surface, and a perpendicular circular hole in the first flat surface of each fork to allow a stub axle of a wheel to fit therein.

The grip includes a first 1703 and second 1702 finger ring. The finger rings 1703, 1702 are provided in various sizes. Sizes can correlate to a certain inside diameter to allow a finger, such as index, middle, ring, thumb, or pinky finger to fit into the finger rings 1703, 1702. As with other grips, the finger rings 1703, 1702 are for manually gripping the application utensil 1700 when loading a coloring composition onto a wheel and when applying the coloring composition. The gauge of the bands comprising the finger rings 1703, 1702 are available in various thicknesses. The finger rings 1703, 1702 bands are available in various axial lengths.

The direction of travel of a wheel in the wheel well 1706 is perpendicular to axial centers 1743, 1742 of the finger rings 1703, 1702, and therefore, the axis of rotation 1740 of a wheel in the wheel well 1706 is parallel to the axial centers 1743, 1742 of the finger rings 1703, 1702. Further, the axis of rotation 1740 of a wheel in the wheel well 1706 together with the lines passing at the axial centers 1743, 1742 of the finger rings 1703, 1702 describe the points of a triangle, where the base of the triangle is a line connecting the axial centers 1743, 1742 of the finger rings 1703, 1702. In one embodiment, the triangle is an isosceles triangle. In one embodiment, the triangle is an equilateral triangle.

Figure 18:
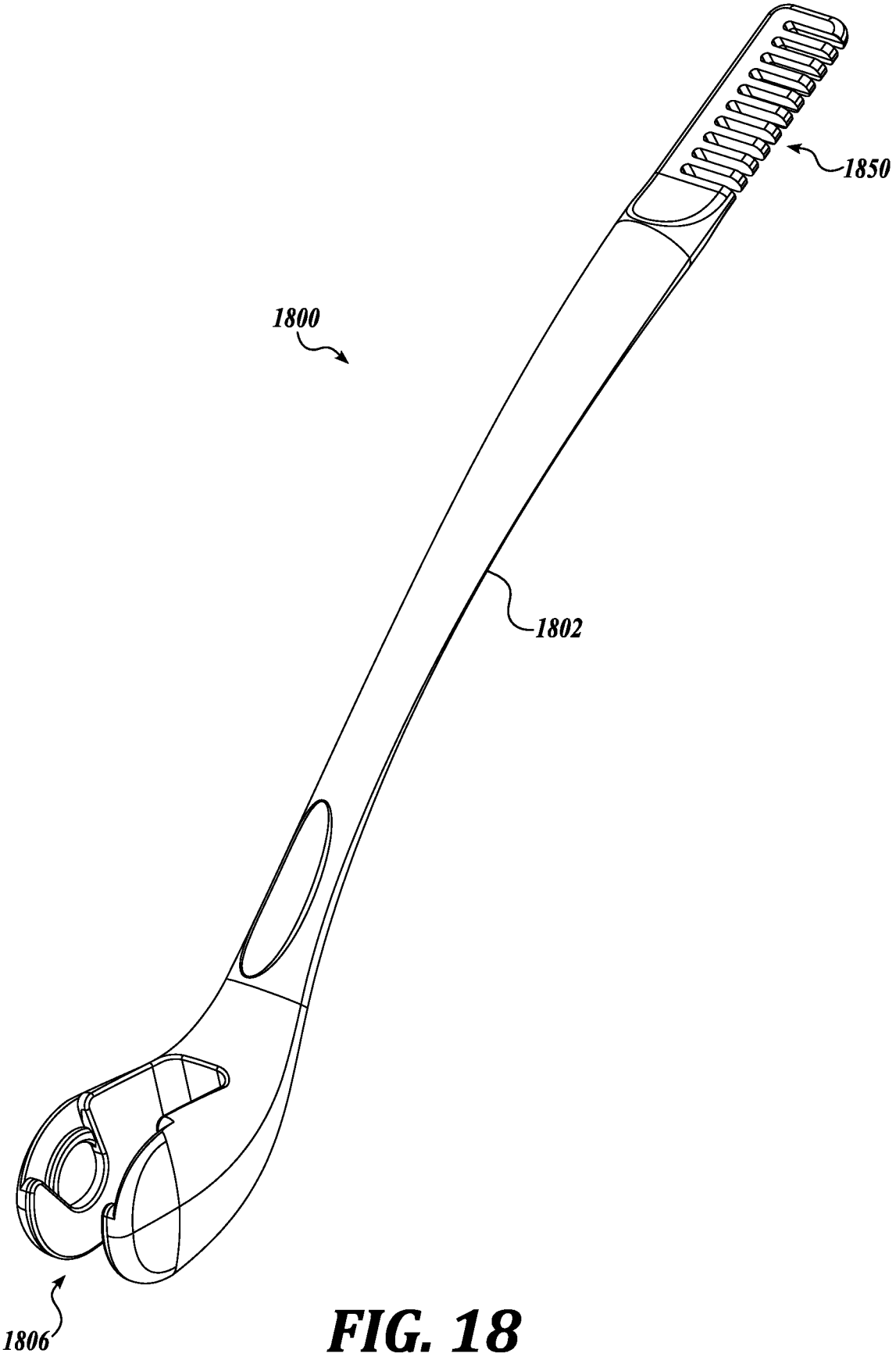
FIG. 18 is a diagrammatical illustration of an application utensil according to one embodiment.

Referring to FIG. 18, an application utensil 1800 is illustrated. In one embodiment, the application utensil 1800 is used for applying a coloring composition to skin. In one embodiment, the application utensil 1800 includes a handle 1802 (also referred to as grip 1802) for manually gripping the application utensil 1800. In one embodiment, the handle 1802 can be straight. In one embodiment, the handle 1802 can be bent or arched. The cross-sectional shape of the handle 1802 can be square, rectangular, circular, or oval, or have a combination of cross-sectional shapes along the length. Although an elongated handle 1802 is shown in one embodiment of the application utensil 1800, the application utensil 1800 can have other manual grips besides a handle.

As in the embodiment of FIG. 1, the application utensil 1800 of FIG. 18 includes a wheel well 1806 configured to receive any wheel. The wheel well 1806 is provided on one end of the handle 1802. In one embodiment, the application utensil 1800 includes a comb 1850 on the end of the handle that is opposite from the wheel well 1806.

Figure 19:
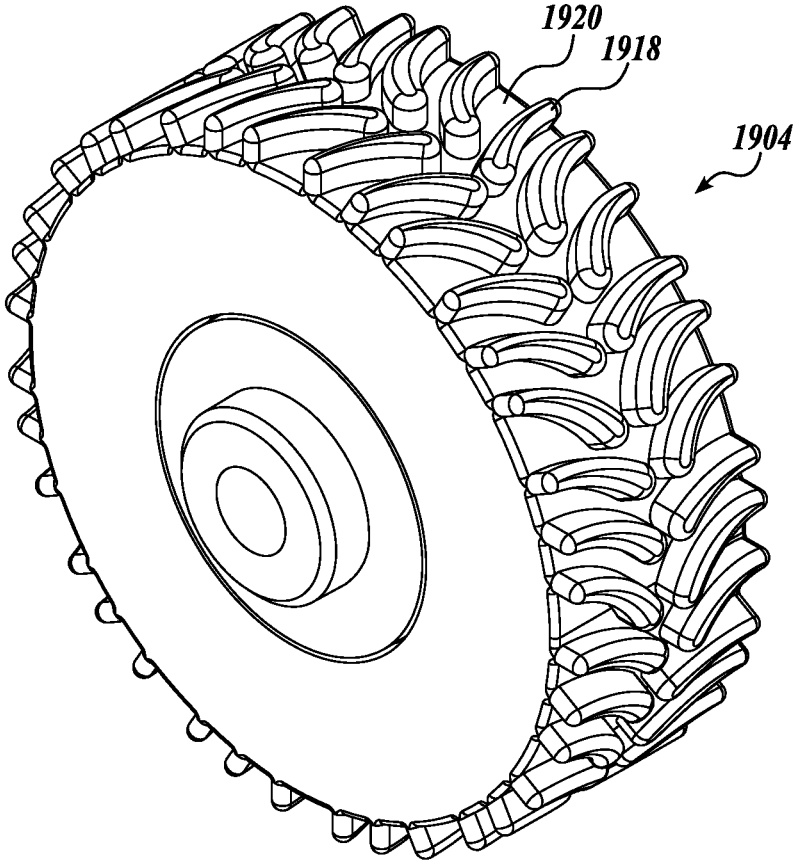
FIG. 19 is a diagrammatical illustration of a wheel according to one embodiment.

Referring to FIG. 19, one embodiment of an outer tread surface of a wheel 1904 is illustrated. The outer tread surface is comprised of raised portions 1918 and submerged portions 1920. Except for the configuration of the outer tread surface, the wheel 1904 is similar in construction and materials to the wheel 104 illustrated in FIGS. 3, 4, and 5.

The outer tread surface pattern of wheel 1904 has "comma" shaped raised portions 1918. Each "comma" shaped raised portion 1918 is separated from the surrounding raised portions via submerged portion 1920. If the circular outer tread surface is laid out flat, it will be seen that the outer tread surface is composed of two mirror halves separated by a submerged portion extending around the entire circumference in the middle of the outer tread surface.

Figure 20A:
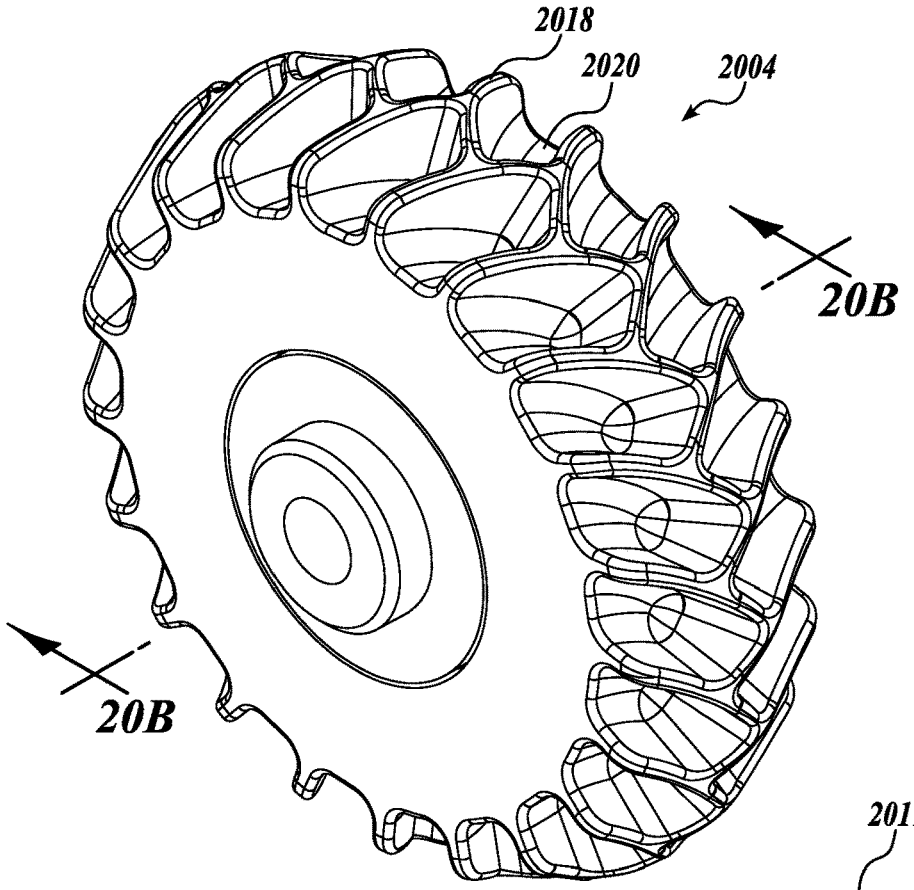
FIG. 20A is a diagrammatical illustration of a wheel according to one embodiment.

Referring to FIG. 20A, one embodiment of an outer tread surface of a wheel 2004 is illustrated. The outer tread surface is comprised of raised portions 2018 and submerged portions 2020. Except for the configuration of the outer tread surface, the wheel 2004 is similar in construction and materials to the wheel 104 illustrated in FIGS. 3, 4, and 5.

Figure 20B:
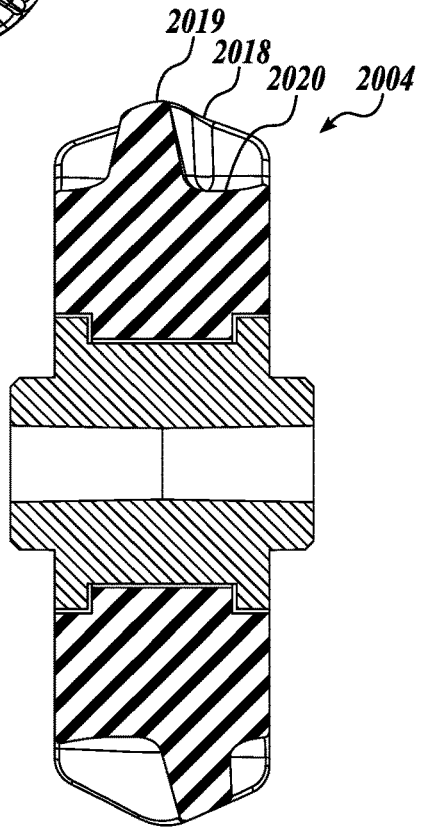
FIG. 20B is a diagrammatical cross-sectional illustration of the wheel of FIG. 20A.

The outer tread surface pattern of wheel 2004 is dissimilar to the outer tread surface pattern of wheel 104 with respect to the draft of the outer tread surface. As described above, "draft" is defined as the distance or radius from the axial center of the wheel to the outer tread surface along the thickness of the wheel. The wheel 104 in FIG. 4 has a generally constant draft along the thickness, except at the edges. In comparison, the cross section of wheel 2004, illustrated in FIG. 20B showing the thickness dimension of wheel 2004, has an outer surface tread that bulges radially outward in the middle at a crest 2019 by having a radius that increases from the edges toward the center of the tread. In one embodiment, the submerged portions 2020 of the outer tread surface are generally at the same radius except at the edges of the thickness. In one embodiment, the raised portions 2018 have a radius that increases from the edges of the thickness toward the center of the tread. An outer tread surface having a draft that bulges radially outward at the center of the tread surface allows the user to change the pattern that is printed on the skin by either increasing or decreasing the pressure applied by the wheel to the skin.

Figure 21:
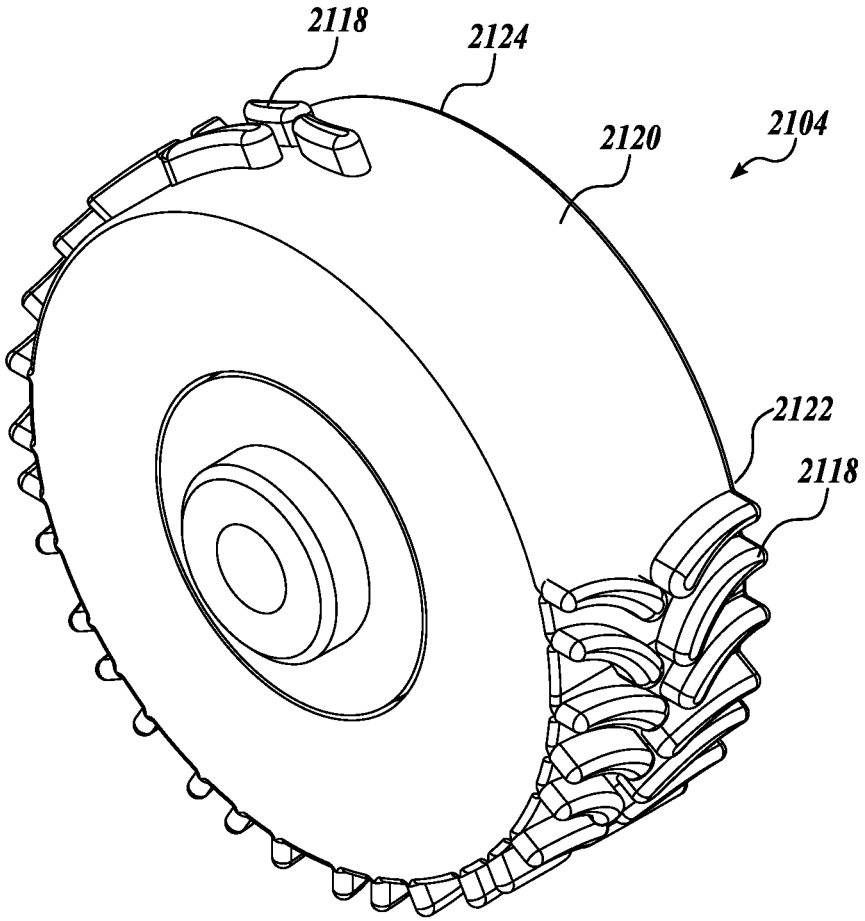
FIG. 21 is a diagrammatical illustration of a wheel according to one embodiment.

Referring to FIG. 21, one embodiment of an outer tread surface of a wheel 2104 is illustrated. The outer tread surface is comprised of raised portions 2118 and submerged portions 2120. Except for the configuration of the outer tread surface, the wheel 2104 is similar in construction and materials to the wheel 104 illustrated in FIGS. 3, 4, and 5.

The outer tread surface pattern of wheel 2104 has "comma" shaped raised portions 2118. Each "comma" shaped raised portion 2118 is separated from the surrounding raised portions via submerged portion 2120. It is seen that the raised portions 2118 are not placed consistently around the circumference of the wheel 2104. The raised portions 2118 further only occupy a circumference from point 2122 to point 2124. Submerged portion 2120 occupies the circumference between points 2122 to 2124. The raised portions 2118 are generally placed in pairs around the circumference so that each one of a pair is the mirror image of its counterpart. The raised portions 2118 have a first angle starting at point 2122. The angle of the raised portions 2118 at point 2122 can be seen as generally lying axially. With each successive pair, the angle of the raised portions 2118 can change. In one embodiment, each successive pair of raised portions 2118 going from point 2122 to point 2124 has an increase in angle with respect to the central axis of the wheel 2104. Therefore, at point 2124 on the circumference, the last pair of raised portions 2118 lie generally perpendicular to the central axis. A single last raised portion at point 2124 is provided. The pattern that is created with an outer tread surface of wheel 2104 is not continuous. Therefore, the user can position the wheel at the desired location to begin rolling.

Figure 22A:
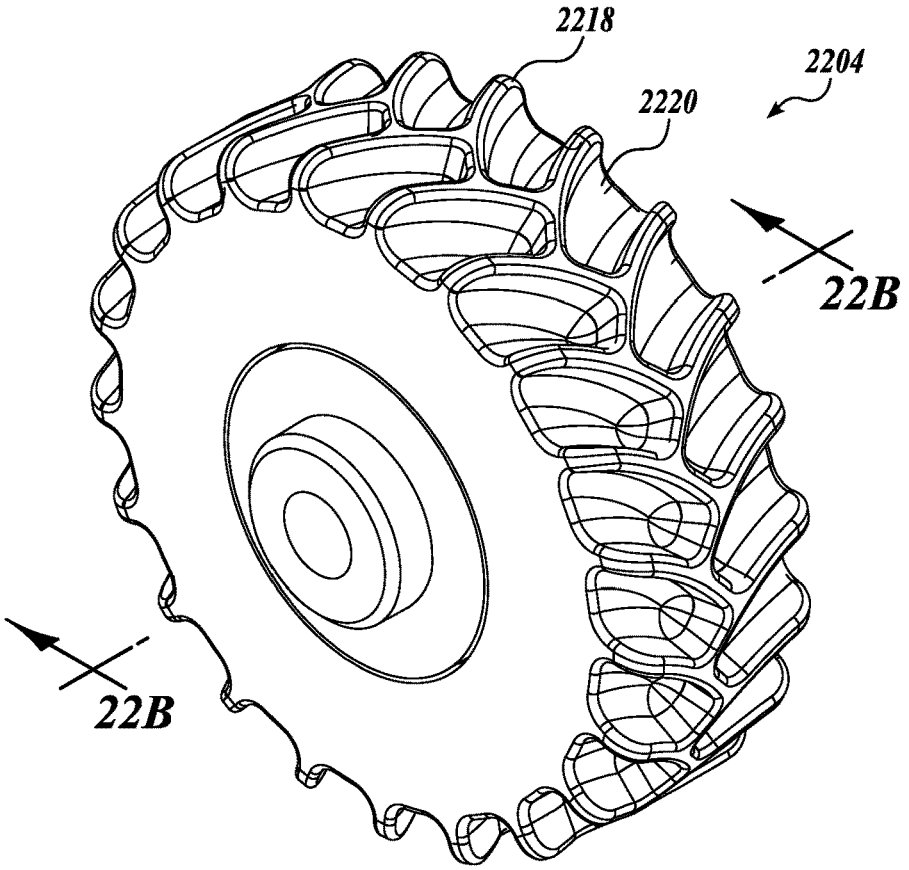
FIG. 22A is a diagrammatical illustration of a wheel according to one embodiment.

Referring to FIG. 22A, one embodiment of an outer tread surface of a wheel 2204 is illustrated. The outer tread surface is comprised of raised portions 2218 and submerged portions 2220. Except for the configuration of the outer tread surface, the wheel 2204 is similar in construction and materials to the wheel 104 illustrated in FIGS. 3, 4, and 5.

Figure 22B:
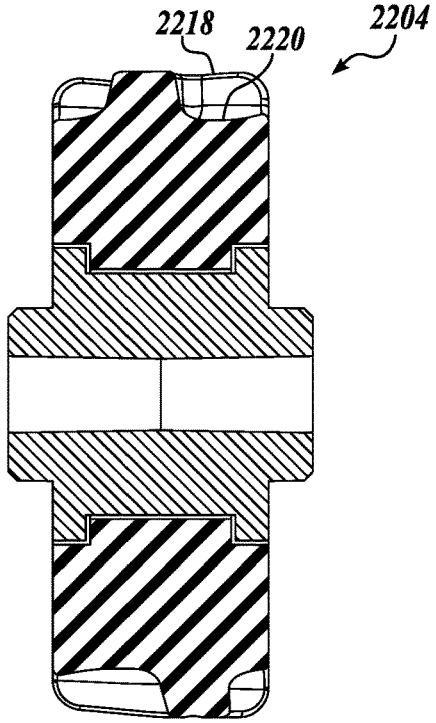
FIG. 22B is a diagrammatical cross-sectional illustration of the wheel of FIG. 22A.

The outer tread surface pattern of wheel 2204 is dissimilar to the outer tread surface pattern of wheel 104 with respect to the draft of the outer tread surface. As described above, "draft" is defined as the distance or radius from the axial center of the wheel to the outer tread surface along the thickness of the wheel. The wheel 104 in FIG. 4 has a generally constant draft along the thickness, except at the edges. In comparison, the cross section of wheel 2204, illustrated in FIG. 22B showing the thickness dimension of wheel 2204, has an outer surface tread that is depressed radially inward in the middle by having a radius that decreases from the edges toward the center of the tread. In one embodiment, the raised portions 2218 have a radius that decreases from the edges of the thickness toward the center of the tread. An outer tread surface having a draft that is depressed radially inward in the center of the outer tread surface allows the user to change the pattern that is printed on the skin by either increasing or decreasing the pressure applied by the wheel to the skin.

In one embodiment, a method of making an application utensil, comprises providing a wheel well that is configured to support one wheel at a time and allows rotation of the wheel, wherein the wheel is removable from the wheel well, and has a manual grip connected to the wheel well; providing a wheel comprising a pattern of raised and submerged regions on an outer tread surface of the wheel; and placing the wheel into the wheel well.

In one embodiment, every application utensil is interchangeable for every other application utensil, and every wheel is interchangeable with every other wheel. The application utensils and wheels disclosed herein allow the creation of artistic patterns with less effort as compared to using an eyebrow pencil, for example. In one embodiment, a wheel with draft is used to allow the user to change the line thickness by varying the pressure during the application.

While illustrative embodiments have been illustrated and described, it will be appreciated that various changes can be made therein without departing from the spirit and scope of the invention.

The embodiments of the invention in which an exclusive property or privilege is claimed are defined as follows:

1. An application utensil, comprising:

a wheel comprising a pattern of raised and submerged regions on an outer tread surface of the wheel;

a wheel well that supports the wheel and allows rotation of the wheel, wherein the wheel is removable from the wheel well; and a manual grip connected to the wheel well, wherein the raised regions transfer a coloring composition onto a surface and the submerged regions replenish the coloring composition to the raised regions, wherein the wheel well comprises a first and second fork connected to each other at a crown, wherein the first and second forks are placed opposite to each other, and inner facing surfaces of the forks have a first flat surface, and a perpendicular circular hole in the first flat surface of each fork, wherein the perpendicular circular hole is connected to a radial opening, wherein the opening follows a first and second tangential line of the perpendicular circular hole and a detent in the shape of an arc is placed in the opening, wherein the detent matches the circumference of the perpendicular circular hole.

2. The application utensil of claim 1, wherein the manual grip comprises an elongated handle or at least one finger ring.

3. The application utensil of claim 1, wherein the outer tread surface bulges radially outward.

4. The application utensil of claim 1, wherein the outer tread surface is depressed radially inward.

5. The application utensil of claim 1, wherein the wheel includes a tread portion of an elastomeric material surrounding a hub portion of a harder material than the elastomeric material.

6. The application utensil of claim 1, wherein the wheel well comprises a first and second fork connected to each other at a crown, wherein the first and second forks are flexible to allow the wheel to be removed.

7. The application utensil of claim 1, wherein the wheel comprises an axle fixed to the center of the wheel and the axle fits into the perpendicular circular hole of each fork.

8. The application utensil of claim 1, wherein the wheel comprises a central hub having an axle projecting outward from each side of the hub.

9. The application utensil of claim 1, wherein the outer tread surface of the wheel is loaded with a coloring composition.

10. The application utensil of claim 1, wherein a diameter to thickness ratio of the wheel is greater than 1.

11. The application utensil of claim 1, wherein a diameter to thickness ratio of the wheel is less than 1.

12. The application utensil of claim 1, wherein the wheel includes a section of a sphere or ovoid.

13. A combination, comprising:

an application utensil of claim 1 having a wheel well that is configured to accept a plurality of wheels; and one or more wheels configured to fit in the wheel well, wherein the one or more wheels have an outer tread surface pattern, wherein the application utensil and the one or more wheels are in a package.

14. The combination of claim 13, further comprising a cushion compact, wherein the cushion compact includes an absorbent material wetted with a coloring composition.

15. The combination of claim 13, comprising more than one wheel, wherein each wheel has a different outer tread surface pattern.

16. The combination of claim 13, wherein the one or more wheels are separate from the application utensil in the package.

17. The combination of claim 13, wherein the application utensil comprises:

the wheel well is configured to support one wheel at a time and allows rotation of the wheel, wherein the wheel is removable from the wheel well; and a manual grip connected to the wheel well.

* * * * *